US012780378B2

(12) United States Patent
Kim

(10) Patent No.: US 12,780,378 B2
(45) Date of Patent: Nov. 3, 2026

(54) MODIFIED VARIABLE HELIX CYLINDERS AND PROPELLER AND NOZZLE USING SAME

(71) Applicant: Byung Jin Kim, Seoul (KR)

(72) Inventor: Byung Jin Kim, Seoul (KR)

( * ) Notice: Subject to any disclaimer, the term of this patent is extended or adjusted under 35 U.S.C. 154(b) by 0 days.

(21) Appl. No.: 18/762,062

(22) Filed: Jul. 2, 2024

(65) Prior Publication Data

US 2024/0383593 A1 Nov. 21, 2024

Related U.S. Application Data

(63) Continuation of application No. PCT/KR2022/021707, filed on Dec. 30, 2022.

(30) Foreign Application Priority Data

Jan. 4, 2022 (KR) ..... 10-2022-0001024

(51) Int. Cl.
*B63H 1/12* (2006.01)
*B63H 11/08* (2006.01)

(52) U.S. Cl.
CPC ..... *B63H 1/12* (2013.01); *B63H 11/08* (2013.01); *B63H 2001/125* (2013.01); *B63H 2011/081* (2013.01)

(58) Field of Classification Search
CPC ..... B64C 11/005; B63G 8/16; B63H 1/12; B63H 11/08; B63H 2001/122; B63H 2001/125
See application file for complete search history.

(56) References Cited

U.S. PATENT DOCUMENTS 3,647,081 A * 3/1972 Engelbart ..... C02F 3/082 261/92
4,022,689 A * 5/1977 Kato ..... C02F 3/10 261/92
4,848,819 A * 7/1989 Moorefield ..... E01H 5/02 294/54.5
5,314,311 A 5/1994 Tada
6,431,926 B1 * 8/2002 Rosefsky ..... F01D 1/38 440/49

(Continued)

FOREIGN PATENT DOCUMENTS

JP 2017-150806 A 8/2017
KR 20-0278161 Y1 6/2002

(Continued)

*Primary Examiner* — Justin D Seabe
(74) *Attorney, Agent, or Firm* — Dinsmore & Shohl LLP

(57) ABSTRACT

Provided is a deformable variable helical cylinder fundamentally based on a helix in a space. The helix starts at a point in a space and rotates around a central axis to draw a trajectory, and has a similar shape to a common spring. The factors defining the helix are the radius, pitch, and height of the helix. A variable helix is a helix of which the radius and period are modified, and the variable helix is characterized by a form in which the radius at the lower end thereof decreases toward the top. A deformable variable helix (mVHC) is a variable helix that is deformed once further, and the biggest feature thereof is that the exit section of the variable helix is deformed to be almost parallel to the central axis of rotation.

4 Claims, 39 Drawing Sheets

(56) References Cited

U.S. PATENT DOCUMENTS

| | | | | |
|---|---|---|---|---|
| 6,470,817 | B2 * | 10/2002 | Delfosse | B63H 5/14 114/280 |
| 9,157,324 | B2 * | 10/2015 | Acosta | B63H 1/12 |
| 9,599,090 | B2 * | 3/2017 | Dale | F03B 3/126 |

FOREIGN PATENT DOCUMENTS

| | | | |
|---|---|---|---|
| KR | 10-0394526 | B1 | 8/2003 |
| KR | 10-2016-0021080 | A | 2/2016 |
| KR | 10-1703873 | B1 | 2/2017 |
| KR | 10-2019-0011575 | A | 2/2019 |

* cited by examiner

PRIOR ART

[7A]

[7B]

[7C]

[7D]

[7E]

[7F]

22A

22B

22C

22D

22E

22F

22G

22H

24A

24B

24C

24D

24E

24F

24G

24H

25A

25B

26A

26B

26C

26D

26E

26F

26G

26H

30A

30B

31A

31B

31C

31D

31E

32A

32B

33A

33B

MODIFIED VARIABLE HELIX CYLINDERS AND PROPELLER AND NOZZLE USING SAME

CROSS-REFERENCE TO RELATED APPLICATIONS

This application is a continuation of International Application No. PCT/KR2022/021707 filed on Dec. 30, 2022, which claims priority to Korean Patent Application No. 10-2022-0001024 filed on Jan. 4, 2022, the entire contents of which are herein incorporated by reference.

TECHNICAL FIELD

The present invention relates to a deformable variable helical cylinder applied by deforming a variable helix, and a propeller and nozzle using the same.

BACKGROUND

One prior art that constructs a propulsion device such a propeller using a helix is "Propeller with screw-shaped blade in ship" of Korean Utility Model No. 20-0278161 published on Jun. 20, 2020. The propulsion portion of the propulsion device illustrated in FIG. 1 is formed of a helical blade 44 welded in a longitudinal direction on a rotation shaft 43 penetrating an inside of a fixed hollow cylindrical casing 42, the rotation shaft 43 is connected to a driven shaft 22, and both ends of the rotation shaft 43 are rotatably supported by rotation support means 70. The propulsion device is configured such that the helical blade 44 rotates to allow seawater to flow into an inlet conduit 32 and then pressurize seawater into a tapered conduit 51 at the same time.

Another prior art that uses a helix to construct a propulsion device such a propeller is "Spiral type reciprocal driving cylindrical propeller" of Korean Patent No. 10-1703873 published on Feb. 7, 2017, in which there is a case where spiral blades or fins are formed on an outer peripheral surface of a cylindrical cylinder extending in one direction and applied to an amphibious vehicle. The cylindrical propeller illustrated in FIG. 2 is configured such that a spiral propulsion protrusion 121 is provided on an outer surface of a cylindrical propulsion member 120 that extends in a front-rear direction to generate a propulsion force.

However, in all of the above prior arts, the spiral blade is only attached to the outside of the cylindrical body, that is, the cylinder, and the cylinder itself is not helically formed. To the extent of the inventor's knowledge, no invention has been previously proposed to obtain the propulsion force by helically forming the cylinder inside the body of any propeller.

SUMMARY OF INVENTION

Technical Problem

An object of the present invention is to provide a cylinder formed of an empty space inside a body.

Another object of the present invention is to provide a propeller and a nozzle in which a deformable variable helical cylinder is formed inside the body.

Another object of the present invention is to provide a cylinder in which an internal flow of a fluid can be adjusted by adjusting a ratio of a body section and an outlet section, the number of revolutions, the number of internal cylinders, the number of external pins and internal cylinders, or the like, a propeller, and a nozzle using the same.

Another object of the present invention is to provide transportation means such as a ship, a submarine, an aircraft, and a drone to which the cylinder, the propeller, the nozzle, or the like described above is applied.

Solution to Problem

The deformable variable helical cylinder of the present invention is fundamentally based on a helix in space. The helix starts from a point in space and draws a trajectory while rotating around a central axis, and is similar in shape to a common spring. The elements that define the helix are a radius, a pitch, and a height of the helix. The variable helix is obtained by deforming the radius and the period of the helix, and has a shape where the radius at a bottom gets smaller upward. The deformable variable helix (mVHC) of the present invention is formed by deforming the variable helix once more. The biggest feature thereof is that an outlet section of the variable helix is deformed to be almost parallel to the rotational central axis.

According to an embodiment of the present invention, there is provided a helical cylinder having a hollow cylindrical shape with a predetermined radius based on a cylinder central line that helically rotates around a rotational central axis, in which the cylindrical shape has a form that helically rotates along the cylinder central line, the cylindrical shape has an inlet for an inflow of a fluid and an outlet for an outflow of the fluid, and the outlet of the cylindrical shape extends parallel to the rotational central axis.

In addition, a diameter of the inlet is larger than a diameter of the outlet, and a diameter of the cylindrical shape gradually decreases from an inlet side to an outlet side.

In addition, a distance between the cylinder central line and the rotational central axis gradually decreases from an inlet side to an outlet side of the cylindrical shape.

According to another embodiment of the present invention, there is provided a helical cylinder having a plurality of basic cylinders that helically rotate around the same rotational central axis, in which each of the basic cylinders has an inlet for an inflow of a fluid and an outlet for an outflow of the fluid, a cylinder body between the inlet and the outlet is closed, the number of revolutions of a helix over an entire length of the helical cylinder is M (where M is a positive real number), and the number of basic cylinders is N (where N is a natural number).

In addition, the N basic cylinders are spaced apart from each other in the same phase.

In addition, a diameter of the basic cylinder gradually decreases from an inlet side to an outlet side, and the outlet portion of the basic cylinder is provided with an outlet section in which the basic cylinder extends parallel to the rotational central axis.

In addition, a cross section of the basic cylinder is a circle or a polygon.

According to an embodiment of the present invention, there is provided a propeller including the helical cylinder; and a casing surrounding the helical cylinder.

According to another embodiment of the present invention, there is provided a propeller including a body portion provided with F pins; and N cylinders formed in the body portion, in which F and N are natural numbers, and the cylinders are implemented as empty spaces.

In addition, each of the cylinders is implemented as a hollow space with a predetermined radius based on a cylinder central line that helically rotates around a rotational central axis of the propeller.

In addition, each of the cylinders is provided with an inlet for an inflow of a fluid and an outlet for an outflow of the fluid, and a diameter of the cylinder gradually decreases from an inlet side to an outlet side.

In addition, a distance between the cylinder central line and the rotational central axis gradually decreases from the inlet side to the outlet side.

In addition, the outlet portion of each of the cylinders is provided with an outlet section in which the cylinder extends parallel to the rotational central axis.

In addition, the N cylinders are spaced apart from each other in the same phase.

In addition, the (N, F) is one of (3, 3), (3, 6), and (5, 5).

Meanwhile, according to an embodiment of the present invention, there is provided a nozzle including a cylinder portion having a plurality of basic cylinders that helically rotate around the same rotational central axis; and a drum portion connected to the cylinder portion, in which each of the basic cylinders has an inlet for an inflow of a fluid from the drum portion and an outlet for an outflow of the fluid, a cylinder body between the inlet and the outlet is closed, and the plurality of basic cylinders are spaced apart from each other in the same phase.

In addition, a diameter of the basic cylinder gradually decreases from an inlet side to an outlet side.

In addition, the outlet portion of each of the basic cylinders is provided with an outlet section extending parallel to the rotational central axis.

In addition, a distance of the basic cylinder between the cylinder central line and the rotational central axis gradually decreases from the inlet side to the outlet side.

Advantageous Effects

According to the present invention, a cylinder formed with an empty space inside the body is provided.

In addition, according to the present invention, a propeller and a nozzle are provided in which the deformable variable helical cylinder is formed inside the body.

In addition, according to the present invention, it is possible to provide transportation means such as a ship, a submarine, an aircraft, and a drone to which the cylinder, the propeller, the nozzle, or the like is applied.

Meanwhile, by adjusting the outlet section of the deformable variable helical cylinder of the present invention, or by adjusting one or more of the correlation between the number of fins and the number of revolutions of the cylinder, and the correlation between the number of fins and the number of cylinders, it is possible to control the flow of the fluid inside the cylinder and the thrust of the outlet.

The main difference between the deformable variable helical cylinder (mVHC) of the present invention and a conventional cylindrical cylinder is the cohesion of the water and air currents. First, the water or air current that flows in through the inlet section of the deformable variable helical cylinder due to the external rotational motion or the external pressure enters the body section at high speed and increasing pressure according to the shape of the closed and gradually narrowing cylinder. Second, an internal rotational force is generated within the body section due to the water and air currents entering the body section while maintaining high speed and high pressure. The internal rotational force and the pressure are maintained due to the water and air currents continuously flowing in from the inlet section. Third, the internal rotational force and the pressure gradually increase due to the shape of the cylinder with a gradually narrowing diameter, and are completely concentrated in the outlet section without any water or air current being lost, and are converted into linear thrust and spraying force parallel to the central axis.

In other words, when flowing into the deformable variable helical cylinder of the present invention, the water or air current is naturally converted into the linear motion through the rotational motion using the helix, and thus the inflow water or air current is completely converted into the thrust or the spraying force parallel to the central axis.

The deformable variable helical (mVHC) propeller and the nozzle can also be said to have the same principle as that of the cylinder, in the case of the propeller, the water or air pressure is generated in the cylinder by the external rotational force, and in the case of the nozzle, the water or air pressure acts from the outside. In the case of the nozzle, the water and air pressures that continuously flow into the inlet section of the nozzle maintain the internal rotational force of the nozzle, and the pressures gradually increase due to the shape of the cylinder which is gradually narrowed, and are completely concentrated in the outlet section without any water or air current being lost without resistance, thereby being converted into the linear thrust and the spraying force parallel to the central axis.

DETAILED DESCRIPTION

The deformable variable helical cylinder is fundamentally based on a helix in space. A helix starts from a point in space and draws a trajectory while rotating around a central axis (hereinafter referred to as the rotational central axis), and is similar in shape to a common spring. The elements that define the helix are a radius, a pitch, and a height of the helix. Generally, when the helix is projected onto a two-dimensional xy plane, the shape thereof is a circle, and when the helix is projected onto the xz plane or the yz plane, the shape thereof is a sine curve. To put it simply, the pitch can be said to be a period of the sine curve. The height is a total height of the helix in space.

On the other hand, the variable helix is obtained by deforming the radius and the period of the helix. The variable helix has a shape where the radius at a bottom gets smaller upward. In other words, when the variable helix is projected from above onto the two-dimensional plane (xy plane), the shape thereof becomes the helix. The deformable variable helix (mVHC) of the present invention is formed by deforming the variable helix once more. The biggest feature thereof is that an outlet section of the variable helix is deformed to be almost parallel to the rotational central axis.

A cylinder to which such a deformable variable helix is applied can naturally convert water and air currents flowed in through rotational motion into linear motion through rotational motion. In addition, if an angle and a shape are set such that the maximum water and air currents are flowed into the cylinder at the inlet section, this leads to an increase in internal pressure, thereby resulting in a more powerful linear motion. In addition, the deformable variable helical cylinder is closed except for the inlet and outlet, so there is no water or air current lost when the water or air current changes from the rotational motion to the linear motion, so the water or air current can be converted into a thrust or spraying force which is completely parallel to the central axis.

Hereinafter, the principle of the helix and application examples of the deformable variable helical cylinder will be described in detail using the accompanying drawings.

Figure 1:
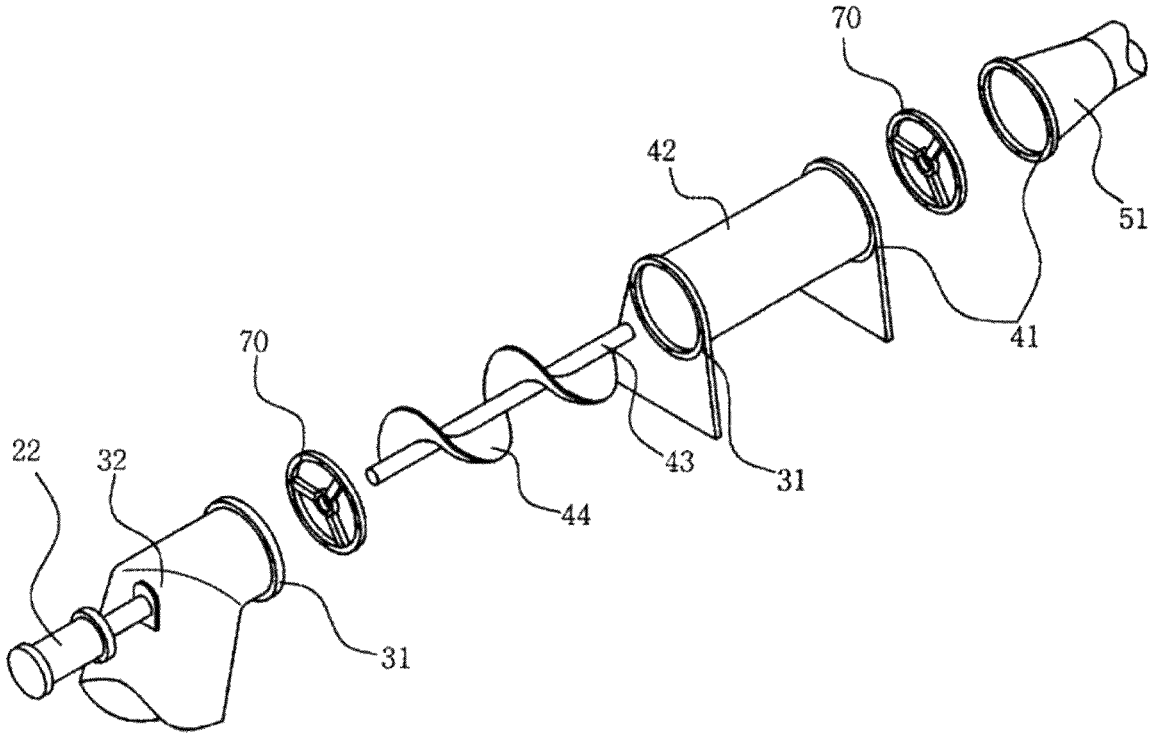
FIG. 1 illustrates a propeller with screw-shaped blade in ship according to the prior art.
Figure 2:
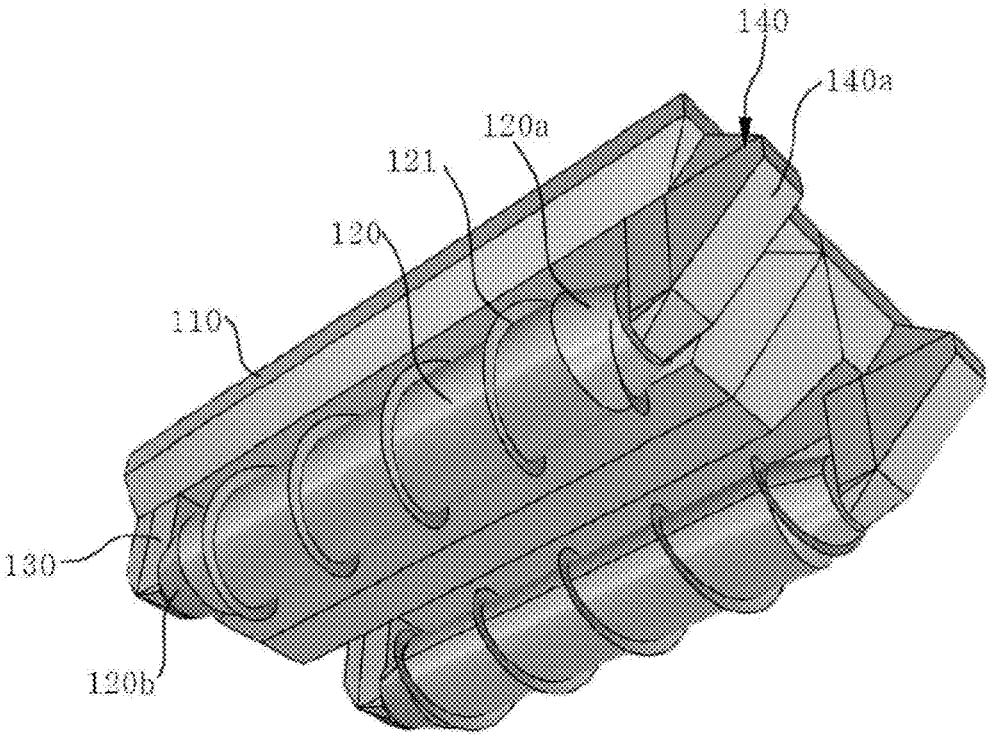
FIG. 2 illustrates a spiral type reciprocal driving cylindrical propeller according to the prior art.
Figure 3:
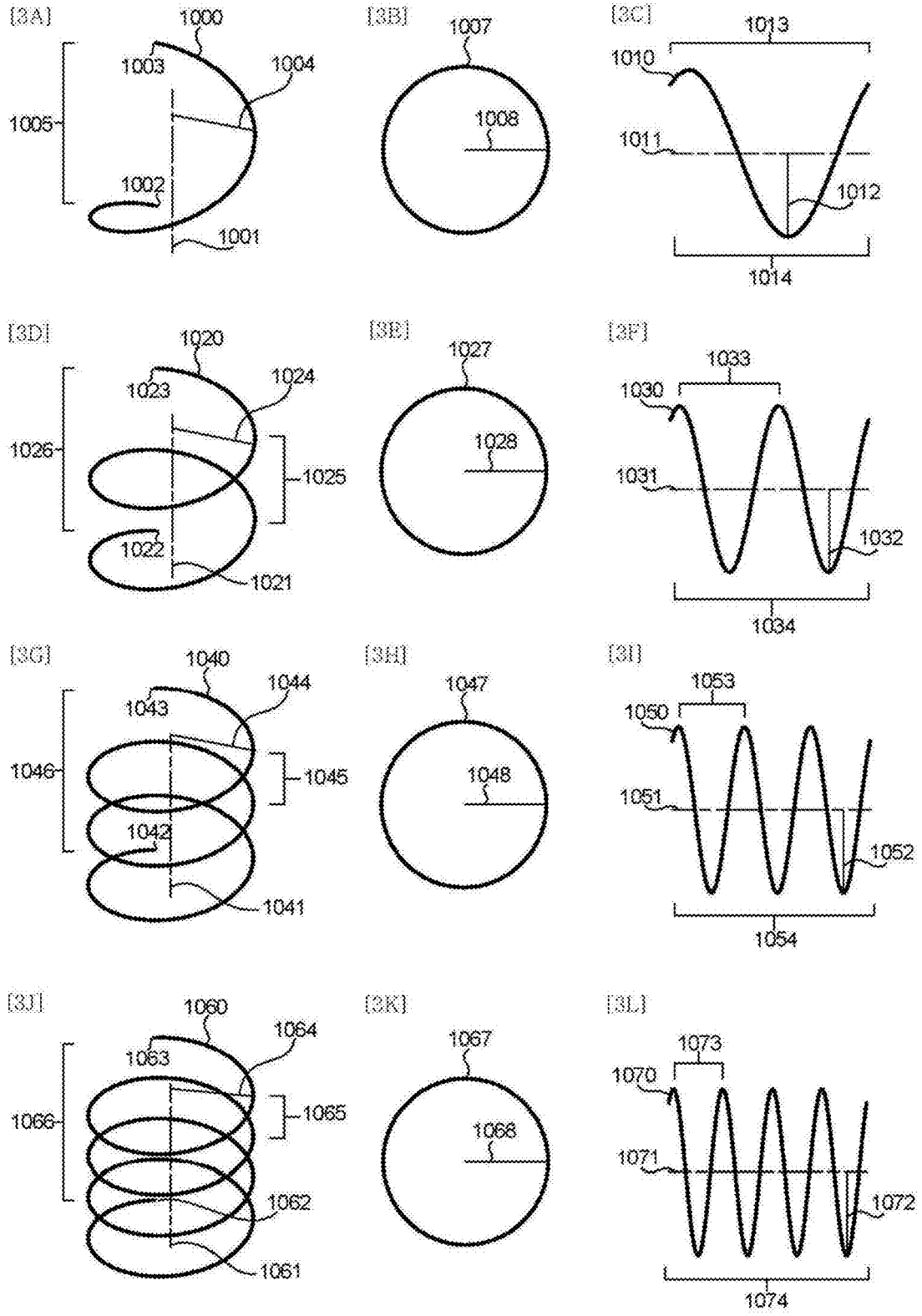
FIGS. 3A-3L illustrate various examples of helices according to the present invention.
Figure 4:
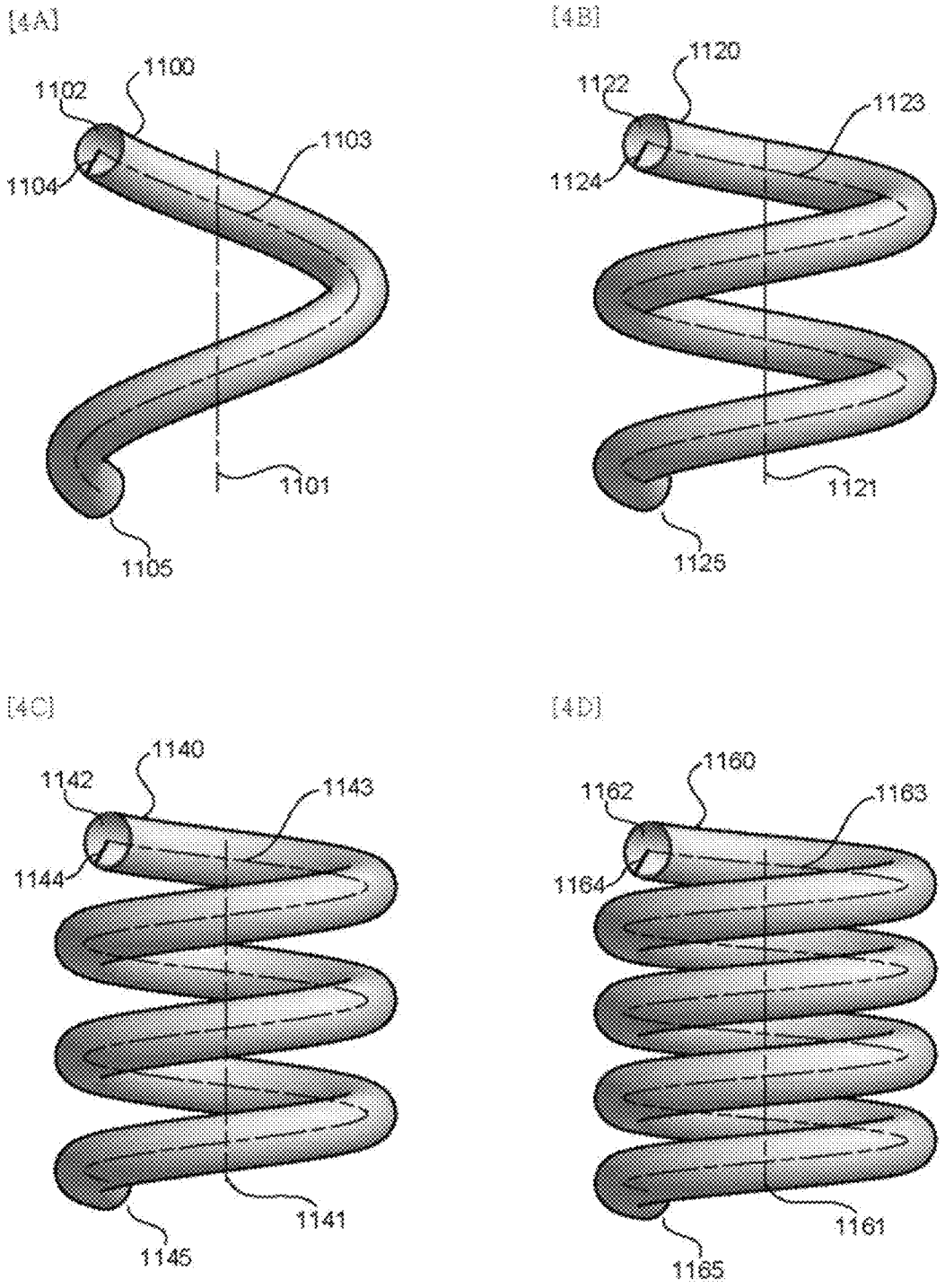
FIGS. 4A-4D illustrate various examples of a helical cylinder according to the present invention.

FIG. 3 illustrates helices and is configured of detailed views of FIGS. 3A to 3L projected in different directions.

The helix is a continuous curve in a three-dimensional space that rotates around a certain axis. The helix is generally expressed using the parametric equations below.

$$x(t) = a \cdot \cos(t)$$

$$y(t) = a \cdot \sin(t)$$

$$z(t) = b \cdot t$$

The helix 1000 in FIG. 3A has a shape which rotates from a starting point 1002 to an ending point 1003 at a regular interval, that is, a radius 1004, around a rotational central axis 1001. The radius 1004 of the helix refers to a in the parametric equation, and a pitch of the helix ($=2\pi \cdot b$) refers to a distance between a crest and a crest, or between a root and a root on the vertical axis (z axis), and corresponds to a distance from one point on the helix to another point located on the same z axis based on the vertical z axis.

The helix 1000 in FIG. 3A rotates a total of once around the rotational central axis 1001 and has a constant radius a and a constant pitch $2\pi \cdot b$. In the case of a 1-revolution helix, the height and the pitch of the helix are equal to each other in size. FIG. 3B illustrating a helix 1007 is a plan view of the helix 1000 of FIG. 3A with a radius a 1008, and it can be seen that the shape of the helix 1000 when viewed from above is a circle. The helix 1010 in FIG. 3C corresponds to a side view of the helix 1000 of FIG. 3A rotated by 90 degrees, and its shape is a sine curve with a rotational central axis 1011 (1001 in FIG. 3A), a radius 1012 (1004 in FIG. 3A) and a pitch 1013 (1005 in FIG. 3A).

Each of helices 1020, 1027, and 1030 in FIGS. 3D, 3E, and 3F has a shape which rotates two times from the starting point 1022 to the ending point 1023 around the rotational central axis 1021. As in the case of the helix sets illustrated in FIGS. 3A, 3B, and 3C, also in the helix sets illustrated in the FIGS. 3D, 3E, and 3F, FIG. 3E is a top view of the helix illustrated in FIG. 3D, and FIG. 3F is a side view of the helix in FIG. 3D with the rotation of 90 degrees. This directional relationship between those helices in each helix set in the drawings of FIG. 3 also applies to the other helix sets below.

Respective detailed drawings of FIG. 4, FIGS. 4A, 4B, 4C, and 4D, illustrates a helical cylinder corresponding to the helix in FIGS. 3A, 3D, 3G and 3J, respectively.

The helical cylinder 1100 in FIG. 4A rotates one time from one end 1105 to the other end 1102 around the rotational central axis 1101, and is a hollow cylindrical helical structure having the radius 1104 (hereinafter referred to as cylinder radius) based on the cylinder central line 1103.

The helical cylinder 1120 in FIG. 4B rotates two times from one end 1125 to the other end 1122 around the rotational central axis 1121, and is a hollow cylindrical helical structure having the radius 1124 based on the cylinder central line 1123.

The helical cylinder 1140 in FIG. 4C rotates three times from one end 1145 to the other end 1142 around the rotational central axis 1141, and is a hollow cylindrical helical structure having the radius 1144 based on the cylinder central line 1143.

The helical cylinder 1160 in FIG. 4D rotates four times from one end 1165 to the other end 1162 around the rotational central axis 1161, and is a hollow cylindrical helical structure having the radius 1164 based on the cylinder central line 1163.

In this way, the helical cylinder that rotates n times can be generalized.

Figure 5:
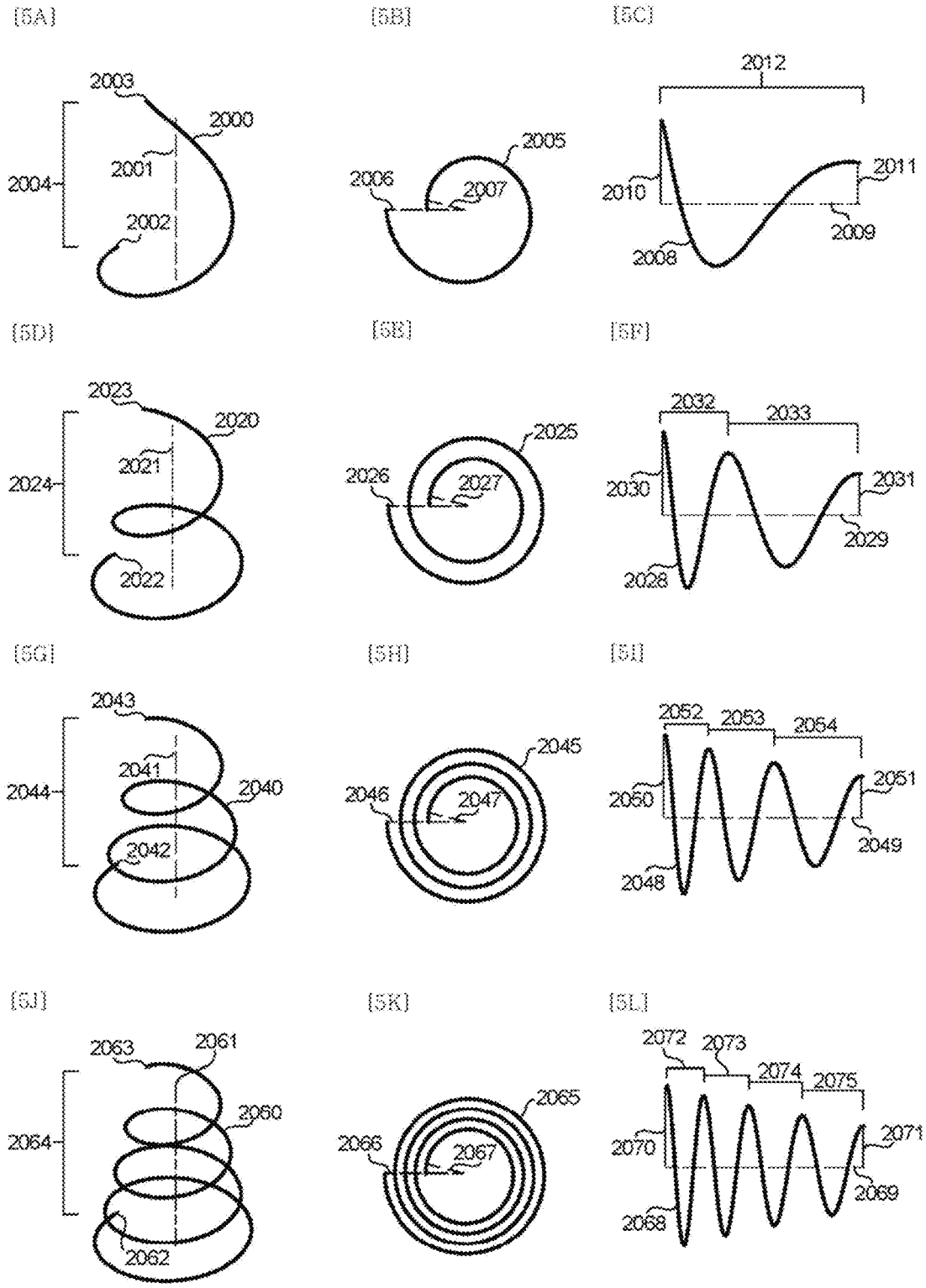
FIGS. 5A-5L illustrate various examples of a variable helix according to the present invention.
Figure 6:
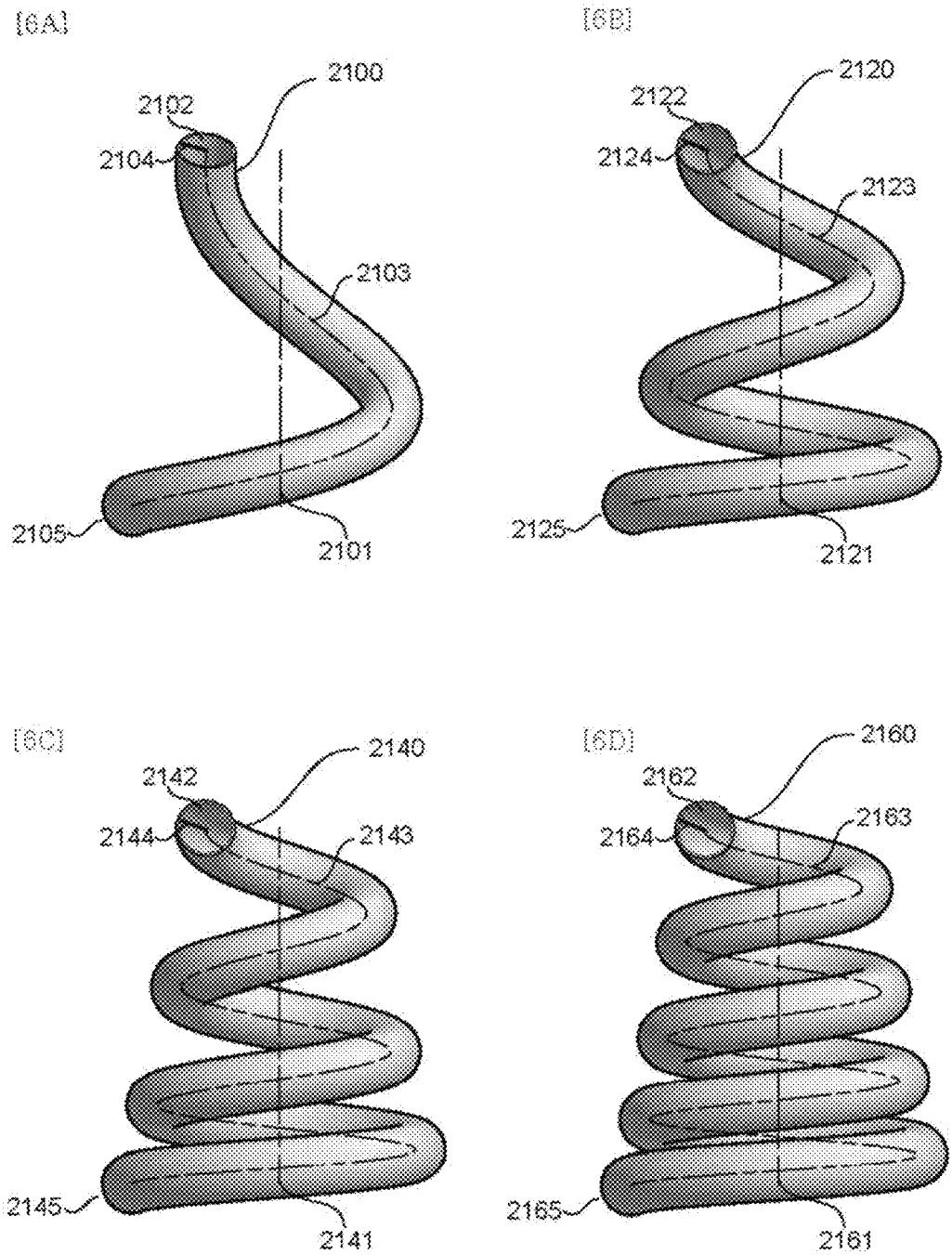
FIGS. 6A-6D illustrate various examples of a variable helical cylinder according to the present invention.

FIG. 5 illustrates a variable helix and is configured of detailed views of FIGS. 5A to 5L projected in different directions. The arrangement relationship of each detailed drawing in FIG. 5 is the same as that in FIG. 3.

The variable helix is a continuous curve in a three-dimensional space and has features that the continuous curve rotates around the rotational central axis, and its radius and pitch gradually increase or decrease as it rotates. The variable helix is generally expressed using the parametric equations below.

$$x(t) = a \cdot f(t) \cdot \cos(t)$$

$$y(t) = a \cdot f(t) \cdot \sin(t)$$

$$z(t) = b \cdot f(t)$$

The variable helix 2000 in FIG. 5A has a shape which rotates from a starting point 2002 to an ending point 2003 around a rotational central axis 2001 and of which the radius increase and the pitch decreases upward. The radius 1004 of the helix corresponds to a f(t), and the pitch of the helix corresponds to $2\pi \cdot b \cdot f(t)$.

The helix sets 2000, 2005, and 2008 in FIGS. 5A, 5B, and 5C rotate a total of once (n=1) around the rotational central axis 1001, so the height h and the pitch p of the helix are equal to each other in size. The radius 2006 at the starting point 2002 of the helix 2005 is greater than the radius 2007 at the ending point 2003 in FIG. 5B. FIG. 5B is a plan view of FIG. 5A, and it can be seen that the shape of the helix 2000 when viewed from above is the trajectory of the helix 2005. FIG. 5C illustrating the helix 2008 corresponds to a side view of the helix 2000 in FIG. 5A rotated 90 degrees, and the central axis 2009, decreasing radii 2010 and 2011, and the pitch 2012 equal to the height are illustrated.

Each of helices 2020, 2025, and 2028 in FIGS. 5D, 5E, and 5F has a shape which rotates two times from the starting point 2022 to the ending point 2023 around the rotational central axes 2021 and 2029. The total height 2024 h is equal to the sum of the sizes of the first pitch 2032 including the starting point and the second pitch 2033 including the ending point. As going from the starting point 2022 to the ending point 2023, the size of the radius decreases from the starting radii 2026 and 2030 to the ending radii 2027 and 2031, and the pitch size increases from the first pitch 2032 to the second pitch 2033.

Each of helices 2040, 2045, and 2048 in FIGS. 5G, 5H, and 5I has a shape which rotates three times. The total height 2044 h is equal to the sum of the sizes of the first pitch 2052, the second pitch 2053, and the third pitch 2054. The sizes of the radius and the pitch are varied the same as for FIGS. 5D, 5E and 5F.

Each of helices 2060, 2065, and 2068 in FIGS. 5J, 5K, and 5L has a shape which rotates four times. The total height 2064 h is equal to the sum of the sizes of the first to fourth pitches 2072 to 2075. The sizes of the radius and the pitch are varied the same as for FIGS. 5D, 5E and 5F.

The variable helix applied to the present invention is a variable helix that rotates n times, and the total height h is equal to the sum of each pitch $p_1$ to $P_n$, and the variable helix can be generalized to a variable helix that rotates n times in which the radius decreases and the pitch increases along the moving direction.

In the variable helix above, the case where the radius and the pitch increase along the moving direction of the helix is explained, but a case where both the radius and the pitch decrease, or one of the radius and the pitch is fixed to a constant and only the other increases or decreases, a case where one of the radius and the pitch increase increases and the other decreases, and the like can all be included in the variable helix. Since such concepts are self-evident to those skilled in the art, detailed description will be omitted.

The detailed drawings of FIG. 6, FIGS. 6A, 6B, 6C, and 6D, illustrate a variable helical cylinder corresponding to the helix of FIGS. 5A, 5D, 5G, and 5J, respectively.

The variable helical cylinder 2100 in FIG. 6A rotates one time from one end 2105 to the other end 2102 around the rotational central axis 2101, and is a hollow cylindrical helical structure having the constant radius 2104 based on the cylinder central line 2103.

The variable helical cylinder 2120 in FIG. 6B rotates one time from one end 2125 to the other end 2122 around the rotational central axis 2121, and is a hollow cylindrical helical structure having the constant radius 2124 based on the cylinder central line 2123.

The variable helical cylinder 2140 in FIG. 6C rotates three times from one end 2145 to the other end 2142 around the rotational central axis 2141, and is a hollow cylindrical helical structure having the constant radius 2144 based on the cylinder central line 2143.

The variable helical cylinder 2160 in FIG. 6D rotates four times from one end 2165 to the other end 2162 around the rotational central axis 2161, and is a hollow cylindrical helical structure having the constant radius 2164 based on the cylinder central line 2163.

In this way, a helical cylinder that rotates n times can be generalized.

Figure 7:
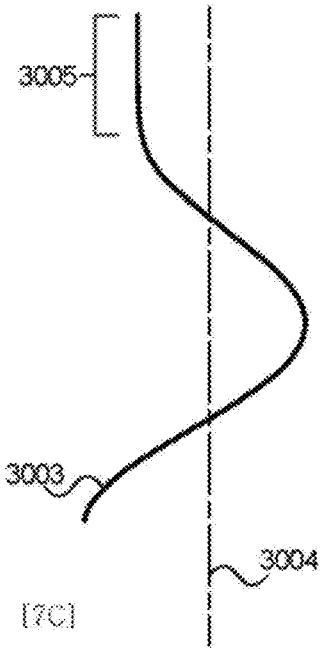
FIGS. 7A-7F illustrate an example of a deformable variable helix according to the present invention.
Figure 7:
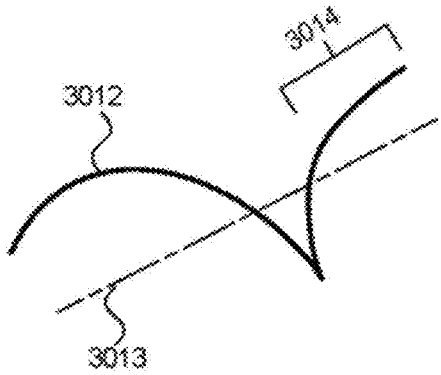
Figure 7:
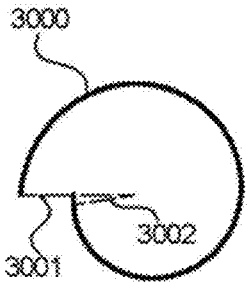
Figure 7:
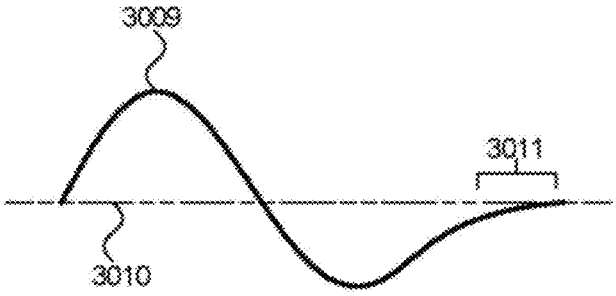
Figure 7:
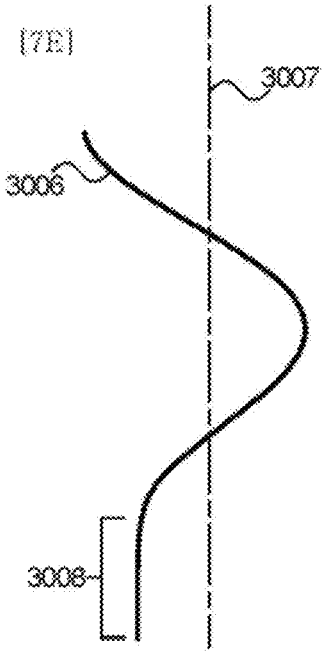
Figure 7:
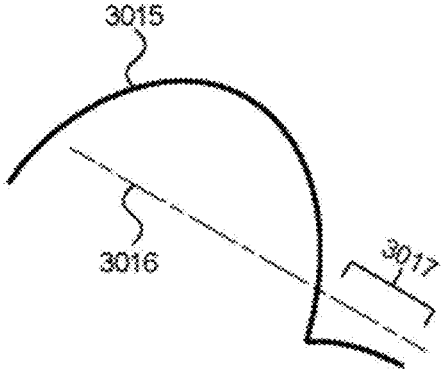

FIG. 7 illustrates a deformable variable helix according to the present invention. The helix set in the detailed drawings of FIGS. 7A to 7F illustrates an example of the 1-revolution deformable variable helix.

The features of the deformable variable helix proposed in the present invention are that the starting radius is larger than the ending radius and that the ending point of the helix does not show a rotation trajectory around the rotational central axis and converges to a straight line almost parallel to the central axis.

The formulas used here are:

$$x(t) = a \cdot \exp(ct) \cdot \cos(t)$$

$$y(t) = a \cdot \exp(ct) \cdot \sin(t)$$

$$z(t) = b \cdot \exp(dt)$$

Based on those, additional deformations are made to converge the straight line near the ending point.

Based on the front view of FIG. 7C, the top view of FIG. 7A, the right side view of FIG. 7D, and the bottom view of FIG. 7E are disposed on the upper, right, and lower sides, respectively, and the isometric view of FIG. 7B and the isometric view of FIG. 7F are disposed on the upper right and lower right sides, respectively.

Referring to the drawings, each of the deformable variable helices 3000, 3003, 3006, 3009, 3012, and 3015 moves from the starting point of the helix portion to the ending point of each of the quasi-straight portions 3005, 3008, 3011, 3014, and 3017 based on the rotational central axes 3004, 3007, 3010, 3013, and 3016, the starting radius 3001 is larger than the ending radius 3002, and the end of the helix is parallel to the rotational central axis to form an almost straight line.

Figure 8:
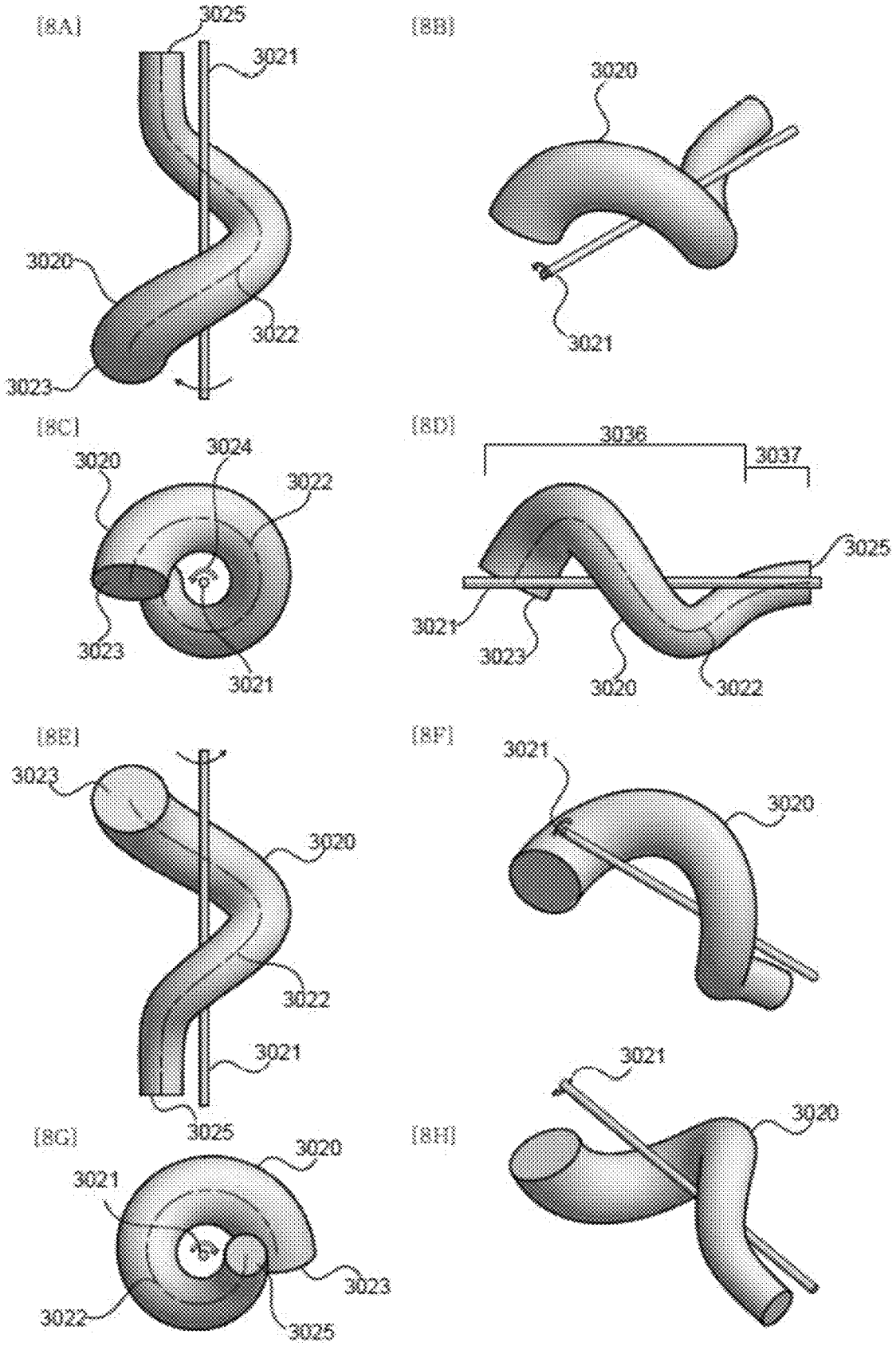
FIGS. 8A-8H illustrates an example of a 1-revolution 1-phase deformable variable helical cylinder according to the present invention.

Each of the detailed drawings of FIG. 8 illustrates a deformable variable helical cylinder (modified variable helical cylinder (mVHC)) according to the present invention.

The deformable variable helical cylinder is a cylinder to which the geometry of the deformable variable helix of the present invention is applied. If there is one cylinder around the rotational central axis, it will be called a 1-phase cylinder, if there are two cylinders, it will be called a 2-phase cylinder, if there are three cylinders, it will be called a 3-phase cylinder, if there are N cylinders, it will be called an N-phase cylinder, and the like.

FIG. 8 is a 1-revolution 1-phase deformable variable helical cylinder, and based on the front view of FIG. 8C, the top view of FIG. 8A, the right side view of FIG. 8D, the bottom view of FIG. 8E, and the rear view of FIG. 8G are disposed on the top, right, lower, and lowest sides, respectively. The isometric views of FIGS. 8B and 8*f*, which are viewed obliquely from the front, are also disposed on the upper right and lower right sides. The isometric view of FIG. 8H is an isometric view which is viewed obliquely from the back. For reference, the same reference numerals are given to the same components, and this applies to the remaining drawings as well.

The deformable variable helical cylinder 3020 of FIG. 8 is designed such that the radius on the inlet side, that is, the starting radius, is larger than the radius on the outlet side, that is, the ending radius. Here, the pitch can be designed to be the same, increase, or decrease in size along the helix moving direction.

The deformable variable helical cylinders of FIGS. 8A to 8H are created with the deformable variable helix 3022 as the cylinder central line, and the deformable variable helix 3022 and the deformable variable helical cylinder 3020 have a shape which is helically rotated around the rotational central axis 3021. The deformable variable helical cylinder is characterized by having a shape that decreases from the inlet 3023 to the outlet 3025, and a shape that progresses in a direction parallel to the rotational central axis near the outlet.

As clearly illustrated in the right side view of FIG. 8D, the deformable variable helical cylinder can be divided into the body section 3036 and the outlet section 3037. The body section 3036 is a section in which the cylinder helically rotates along the helix central line, and the outlet section 3037 is a section that is straightened in a direction parallel to the rotational central axis of the helix in the vicinity of the outlet of the helix.

Now, a case of applying the deformable variable helical cylinder to a propellant will be described.

First, a case is assumed that a rotational force is applied from the outside to the rotational central axis 3021 of the 1-revolution 1-phase deformable variable helical cylinder of FIG. 8 and the cylinder rotates in a certain direction.

In each of FIGS. 8A to 8H, the rotation direction of the deformable variable helical cylinder is indicated by an arrow. Based on the front view of FIG. 8C, the deformable variable helical cylinder 3020 rotates counterclockwise 3024 around the rotational central axis 3021, and in the rear view of FIG. 8G, it rotates clockwise. Accordingly, in the plan view of FIG. 8A, the inlet 3023 of the deformable variable helical cylinder rotates in the direction of coming out from the ground, and in the bottom view of FIG. 8E, the inlet 3023 of the variable helical cylinder rotates in the direction of coming into the ground.

When the deformable variable helical cylinder is placed in a fluid, the fluid such as water or air current flows into the inlet 3023 due to the rotational motion of the deformable variable helical cylinder, moves along the closed cylinder, and then exits through the outlet 3025. In addition, when the fluid flows into the inlet of the deformable variable helical cylinder due to an external rotational force, an internal rotational force is generated as the inflow fluid passes through the body section of the deformable variable helical cylinder. In addition, the inner diameter of the cylinder narrows toward the outlet, so that a pressure is generated in the fluid, and as a result, the compressed fluid is sprayed at the outlet of the deformable variable helical cylinder, and thrust is generated. Using this principle, the deformable variable helical cylinder can be used as the propellant.

Figure 10:
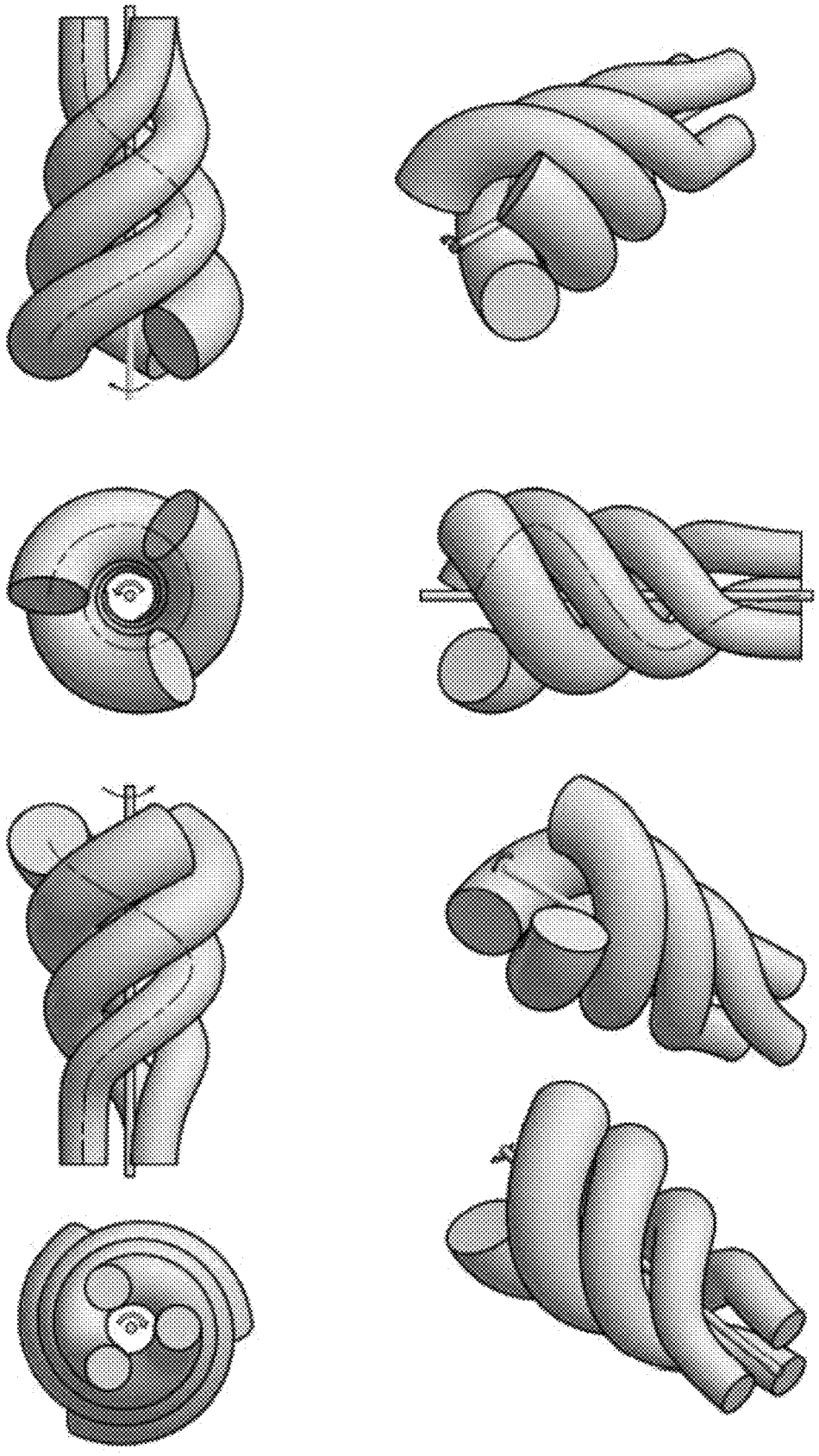
FIG. 10 illustrates an example of a 1-revolution 3-phase deformable variable helical cylinder according to the present invention.
Figure 11:
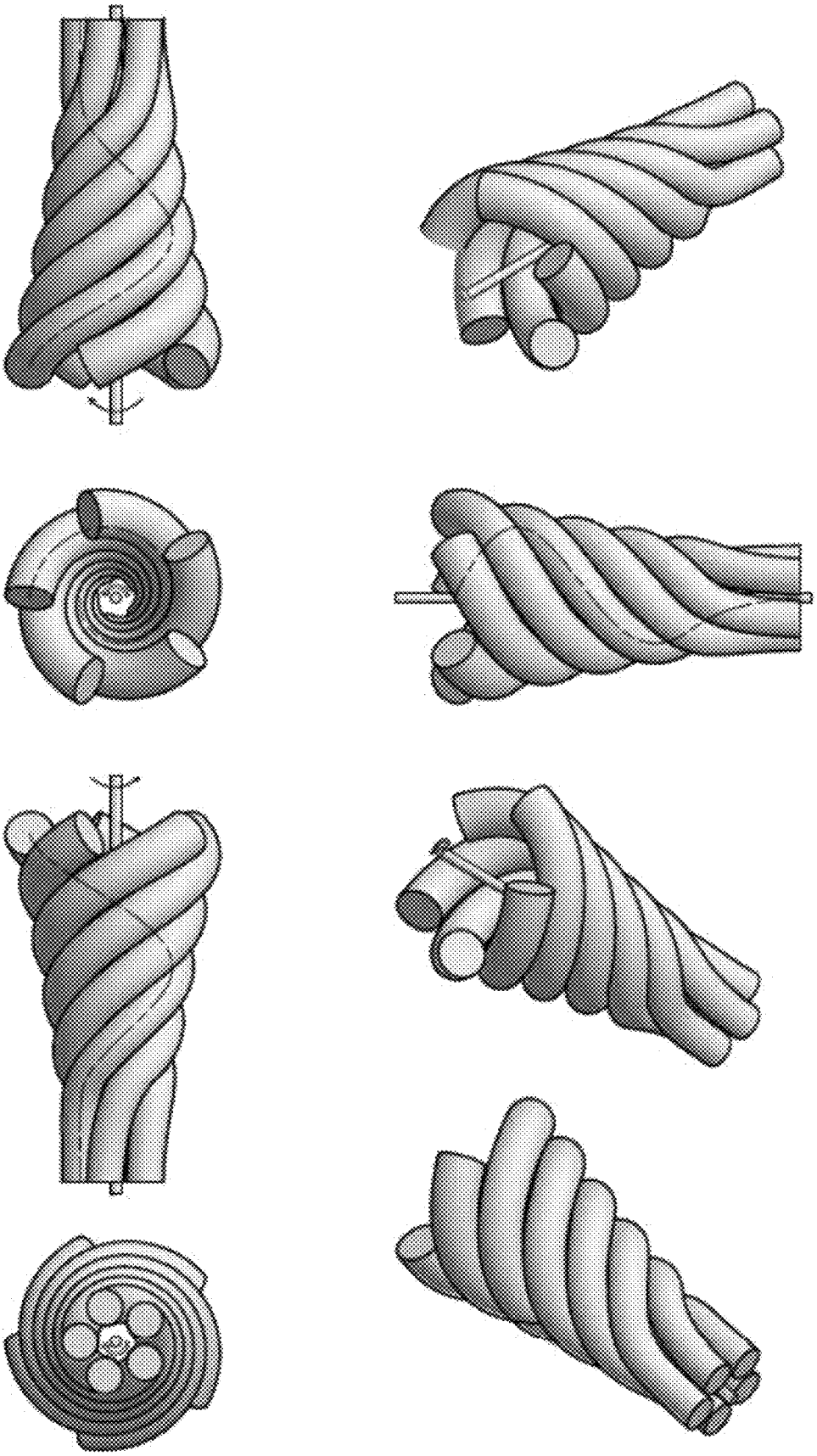
FIG. 11 illustrates an example of a 1-revolution 5-phase deformable variable helical cylinder according to the present invention.

Now, using FIGS. 9 to 11, a multi-phase (N-phase) deformable variable helical cylinder in which two or more cylinders are combined will be described. The mutual arrangement of each detailed drawing in FIGS. 9 to 11 is the same as that in FIG. 8.

Figure 9:
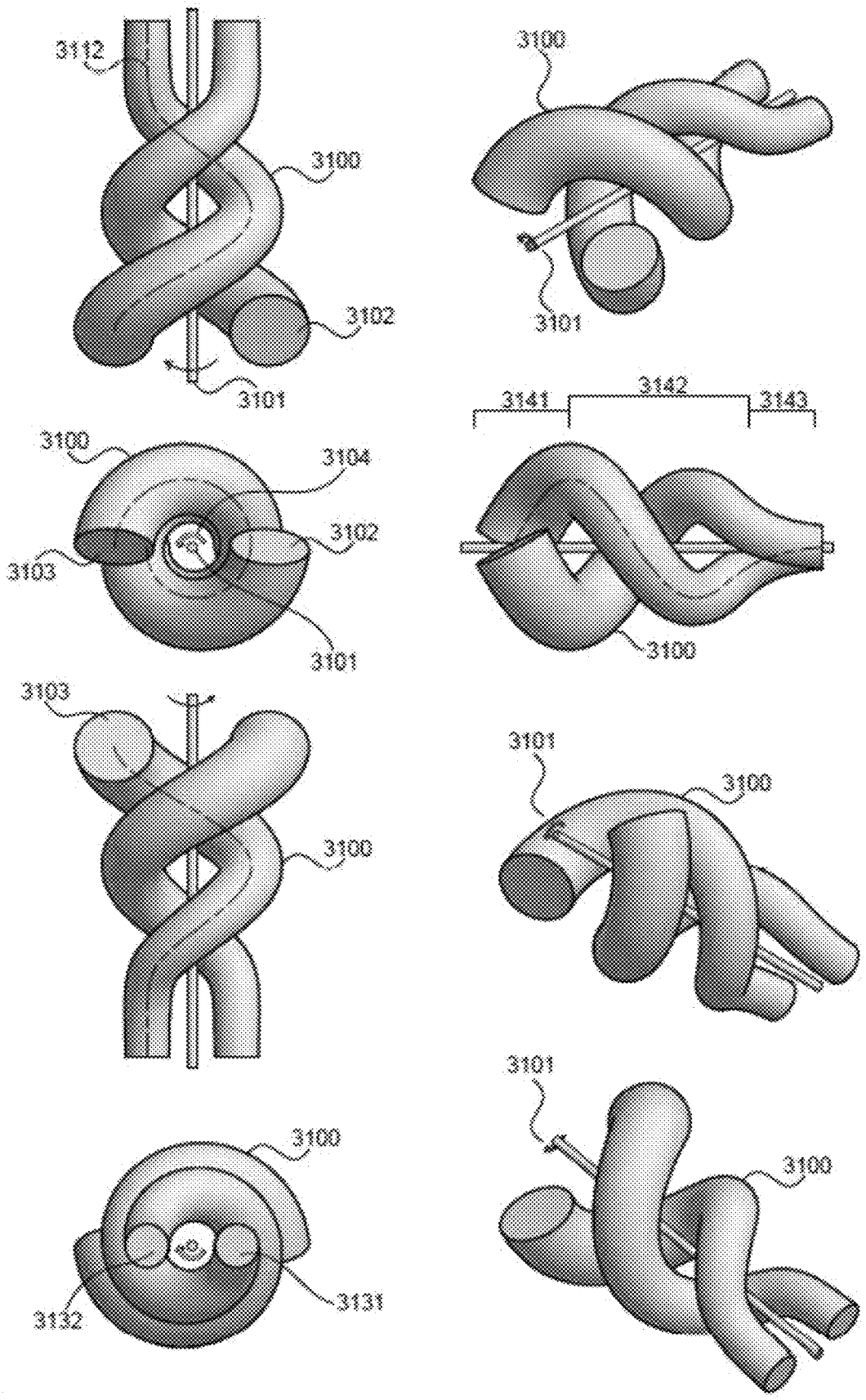
FIG. 9 illustrates an example of a 1-revolution 2-phase deformable variable helical cylinder according to the present invention.

First, the 1-revolution 2-phase deformable variable helical cylinder 3100 illustrated in FIG. 9 are configured by disposing two 1-revolution 2-phase deformable variable helical cylinders alternately. It has a structure in which the two deformable variable helical cylinders of the same shape are disposed with a phase difference of 180 degrees around the rotational central axis 3101. Each of the inlets 3102 and 3103 is oriented in opposite directions, and the cylinder rotates counterclockwise 3104.

Each of the 2-phase deformable variable helical cylinders of FIG. 9 also has the inner diameter that narrows from the inlet side to the outlet side, and has a shape that progresses in a direction parallel to the rotational central axis of the cylinder near the outlet, so each of the outlets 3131 and 3132 is oriented in the same direction. Overall, it can be divided into the body sections 3141 and 3142 and the outlet section 3143, and the body section can be subdivided into the inlet section 3141 and the body section 3142.

Even in the 1-revolution 2-phase cylinder, when the fluid flows into the cylinder inlet due to the external rotational force, internal rotational force and compression occur as the fluid passes through the body section of the cylinder, and the fluid is sprayed from the outlet to generate the thrust. When the same external rotational force as that in the 1-revolution, 1-phase cylinder acts on the 1-revolution 2-phase cylinder, the total thrust increases proportionally due to the two cylinders.

Next, the 1-revolution 3-phase deformable variable helical cylinder which is configured by disposing three 1-revolution 1-phase deformable variable helical cylinders alternately with a phase difference of 120 degrees will be explained with reference to FIG. 10.

In FIG. 10, each inlet is disposed at an angle of 120 degrees, and the cylinder rotates counterclockwise. Each cylinder of the 1-revolution 3-phase variable-strain helical cylinders also has an inner diameter that narrows from the inlet to the outlet, and near the outlet, and has a shape that progresses in a direction parallel to the rotational central axis of the cylinder. The cylinder can be divided into the body section and the outlet section.

The thrust generation process of the 1-revolution 3-phase cylinder is similar to that of the 1-phase and 2-phase cases, and when the same external rotational force is applied, the total thrust increases proportionally due to the three cylinders.

Next, FIG. 11 illustrates the 1-revolution 5-phase deformable variable helical cylinder obtained by disposing five 1-revolution 1-phase deformable variable helical cylinders alternately with a phase difference of 72 degrees. The operating mechanism of the 1-revolution 5-phase variable helical cylinder is similar to those of the other multi-phase deformable variable helical cylinders. However, the inner diameters of the inlets and outlets of the five individual cylinders applied to the 1-revolution 5-phase cylinder are smaller than those of the 1-revolution 1-phase cylinder.

Now, the multi-revolution deformable variable helical cylinder will be described using FIGS. 12 to 19.

For this purpose, first of all, regarding the multi-revolution deformable variable helix, except that the multi-revolution deformable variable helix is a helix that rotates two or more times, the features, in which the starting radius is larger than the ending radius, the ending point of the cylinder converges to a straight line parallel to the rotational central axis to discharge the fluid parallel to the rotational central axis, and the like are the same as those in the 1-revolution deformable variable helix.

Figure 12:
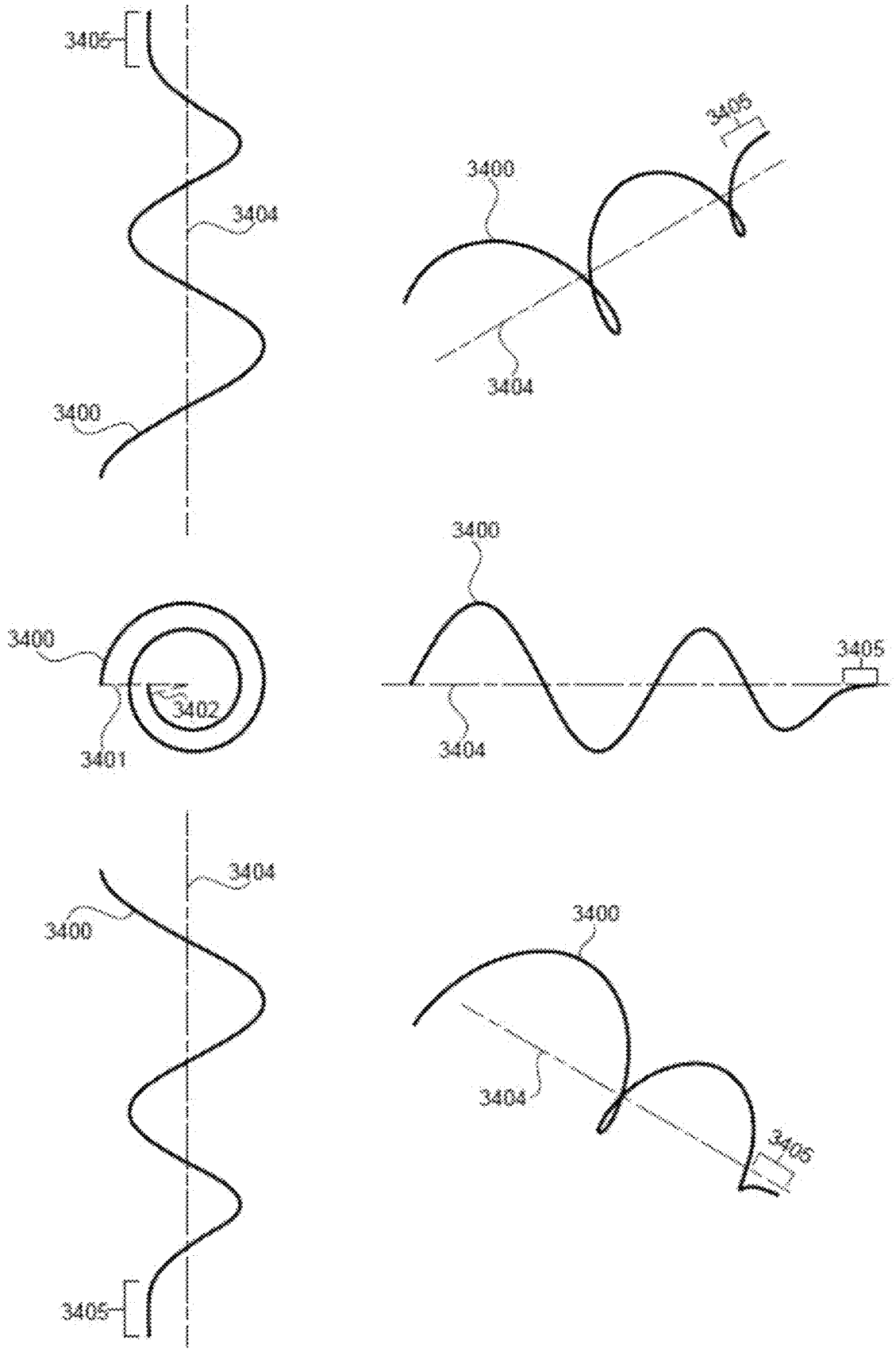
FIG. 12 illustrates an example of a 2-revolution deformable variable helix according to the present invention.

FIG. 12 illustrates an example of the 2-revolution deformable variable helix. The arrangement of the detailed drawings is the same as that of the 1-revolution deformable variable helix in FIG. 7.

Also in the case of the 2-revolution deformable variable helix 3400, the formula representing the geometric shape is the same as that of the 1-revolution deformable variable helix, and the features, in which the starting radius 3401 is larger than the ending radius 3402 and deformation is applied to the near portion of the ending point 3405 to converge to a straight line parallel to the rotational central axis, are also the same as those of the 1-revolution deformable variable helix.

Figure 13:
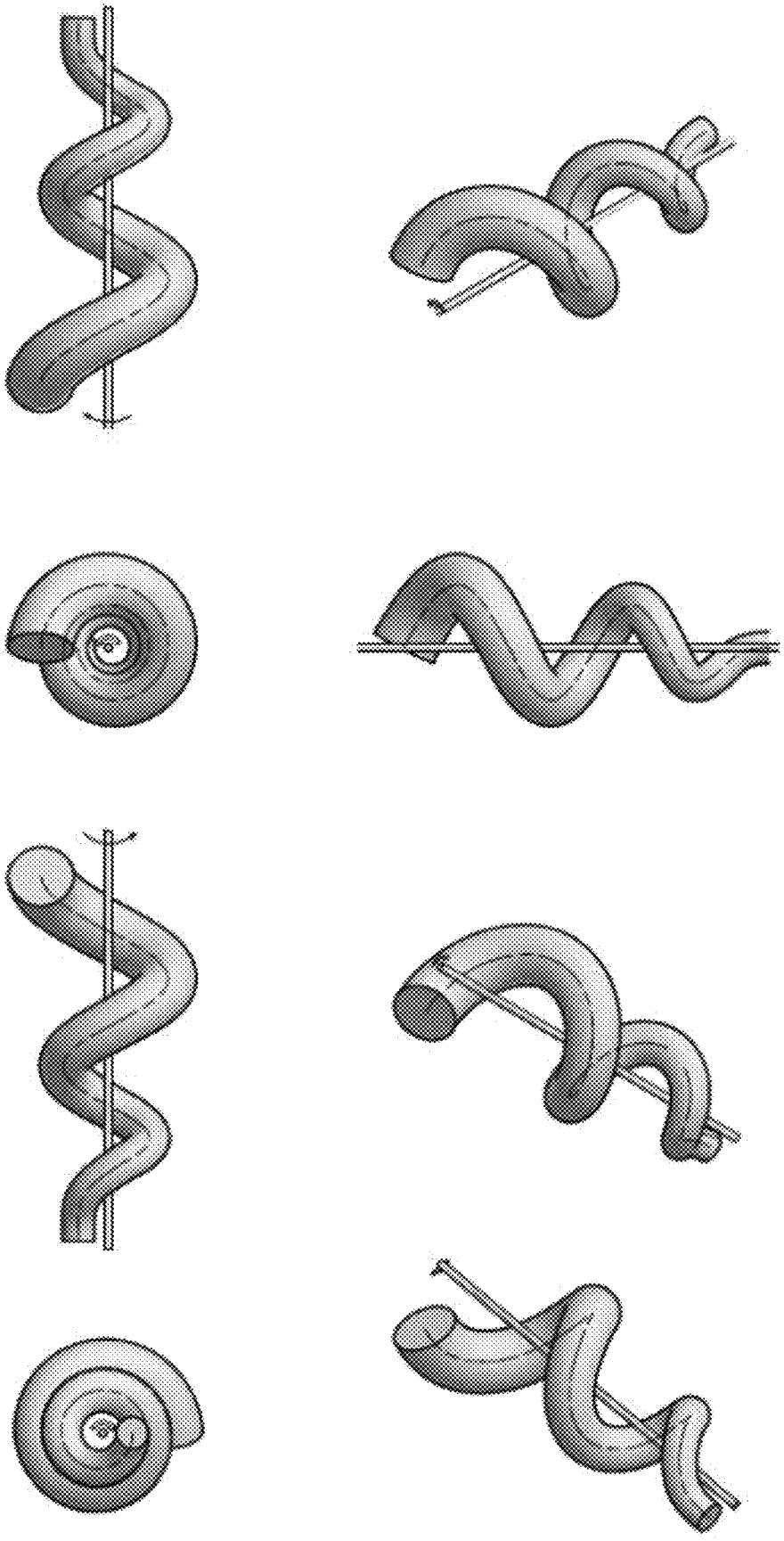
FIG. 13 illustrates an example of a 2-revolution 1-phase deformable variable helical cylinder according to the present invention.

The cylinder view of FIG. 13 illustrates an example of the 2-revolution 1-phase deformable variable helical cylinder to which the 2-revolution deformable variable helix is applied. The illustrated 2-revolution 1-phase deformable variable helical cylinder has a shape in which the radius of the helix and the inner diameter of the cylinder decrease from the inlet to the outlet to increase the compression of the inflow fluid. Here, the arrangement relationship in each drawing is the same as that of the 1-revolution 1-phase deformable variable helical cylinder.

Figure 14:
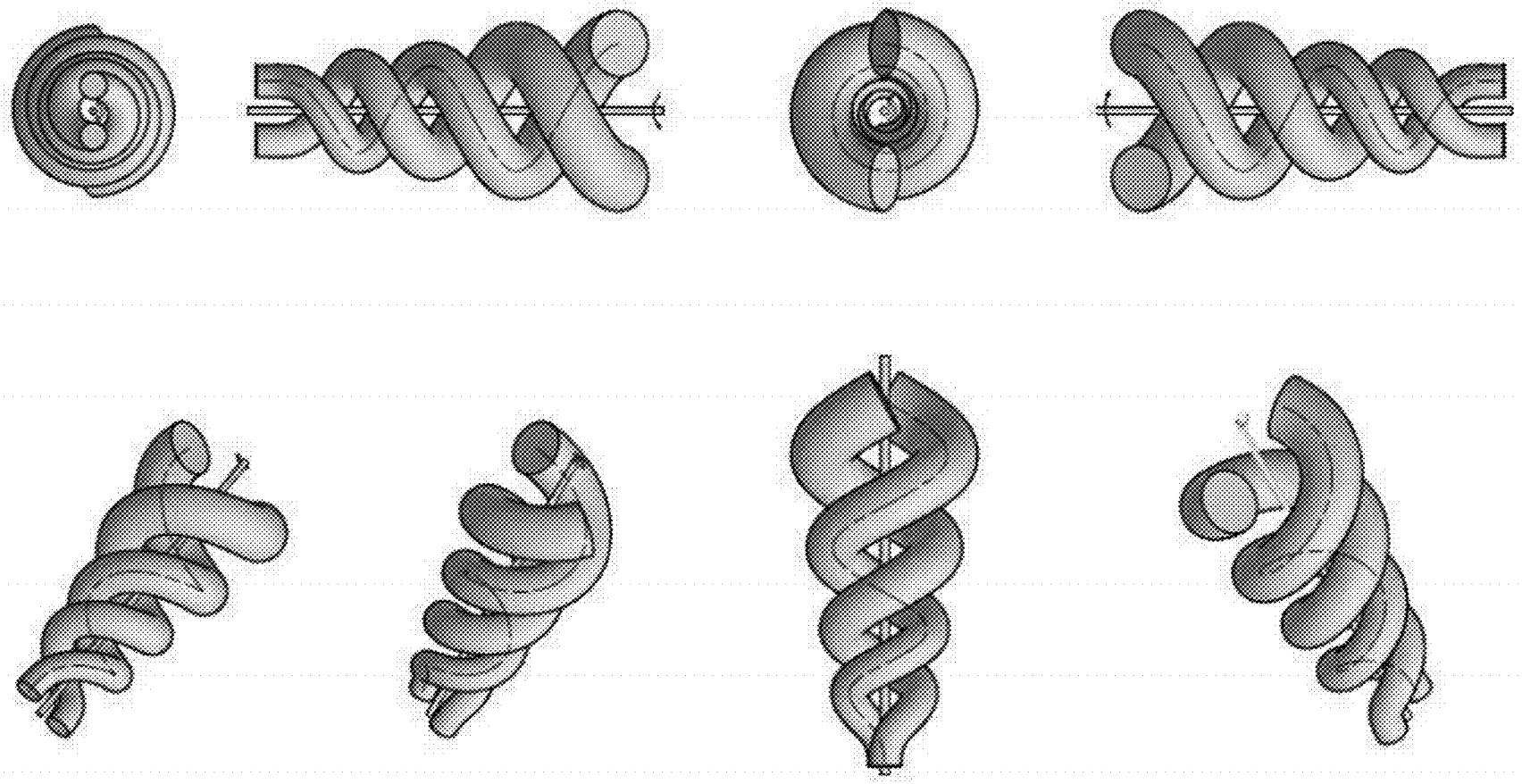
FIG. 14 illustrates an example of a 2-revolution 2-phase deformable variable helical cylinder according to the present invention.

The 2-revolution and 2-phase deformable variable helical cylinder of FIG. 14 is obtained by disposing two 2-revolution 1-phase deformable variable helical cylinders of FIG. 13 with a phase difference of 180 degrees. When the same external rotational force as that in the 2-revolution 1-phase cylinder of FIG. 13 acts on the 2-revolution 2-phase cylinder of FIG. 14, the total thrust increases proportionally due to the two cylinders.

Figure 15:
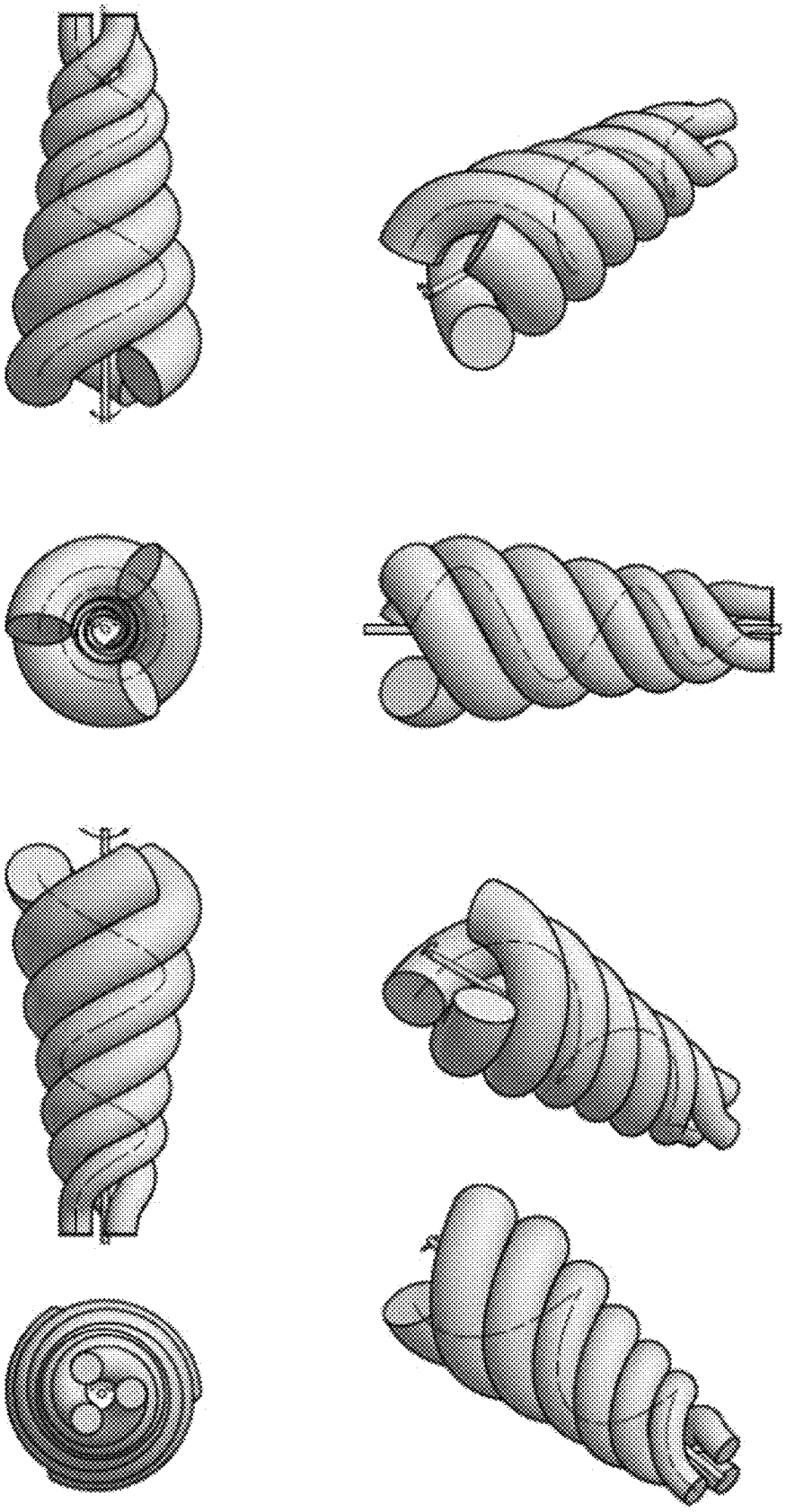
FIG. 15 illustrates an example of a 2-revolution 3-phase deformable variable helical cylinder according to the present invention.

The 2-revolution 3-phase deformable variable helical cylinder of FIG. 15 is obtained by disposing three 2-revolution 1-phase deformable variable helical cylinders of FIG. 13 with a phase difference of 120 degrees, and when the same external rotational force as that of the 2-revolution 1-phase cylinder of FIG. 13 acts on the 2-revolution 3-phase cylinder of 15, the total thrust increases proportionally due to the three cylinders.

Figure 16:
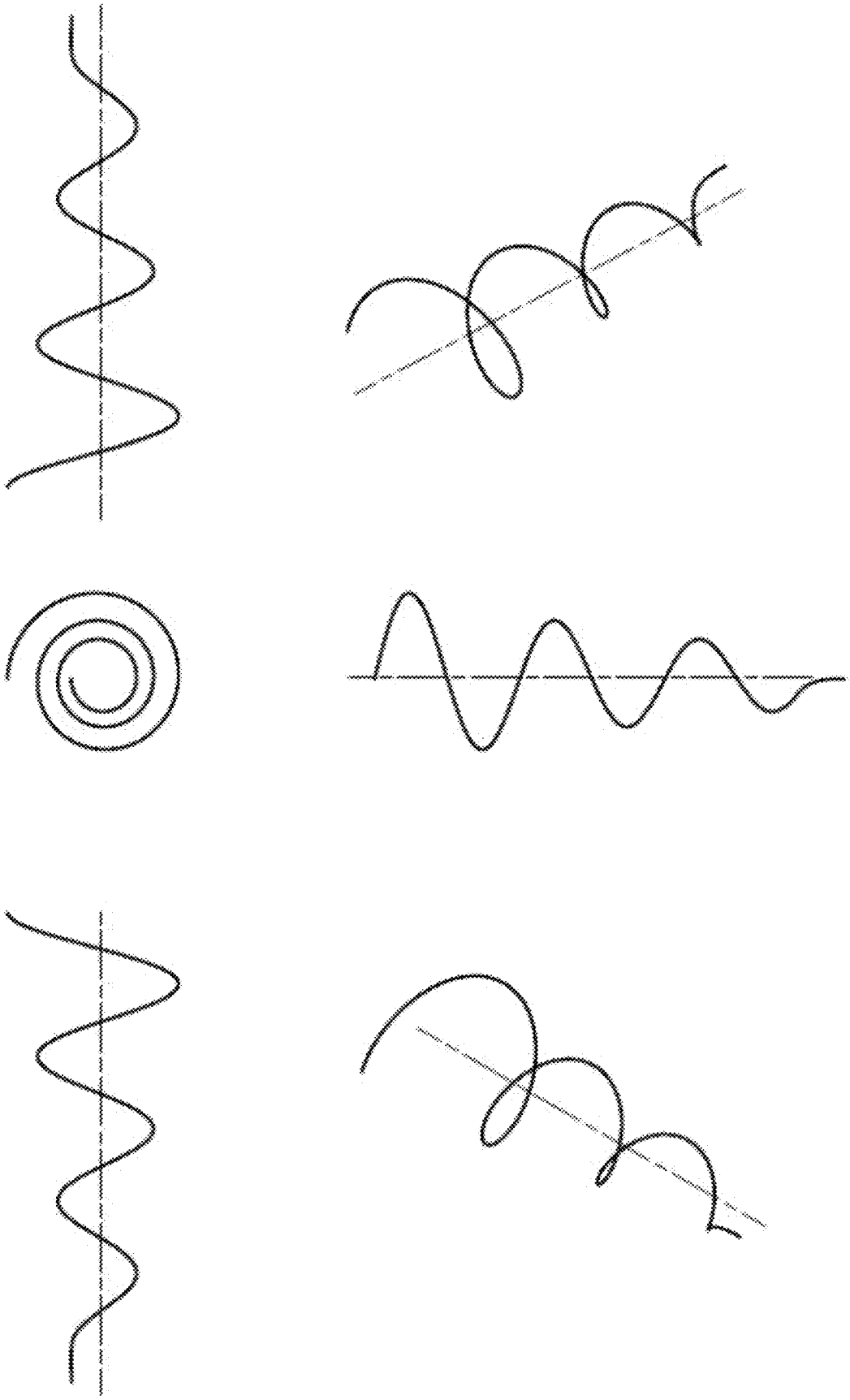
FIG. 16 illustrates an example of a 3-revolution deformable variable helix according to the present invention.

FIG. 16 illustrates an example of the 3-revolution deformable variable helix. The arrangement relationship of each detailed drawing is the same as that in the 1-revolution deformable variable helix of FIG. 7.

Also in the case of the multiple-revolution deformable variable helix of 3 or more revolutions, the formula representing the geometric shape is the same as that of the 1-revolution deformable variable helix, and the features, in which the starting radius is larger than the ending radius and deformation is applied to the near portion of the ending point to converge to a straight line parallel to the rotational central axis, are also the same as those of the 1-revolution deformable variable helix.

Figure 17:
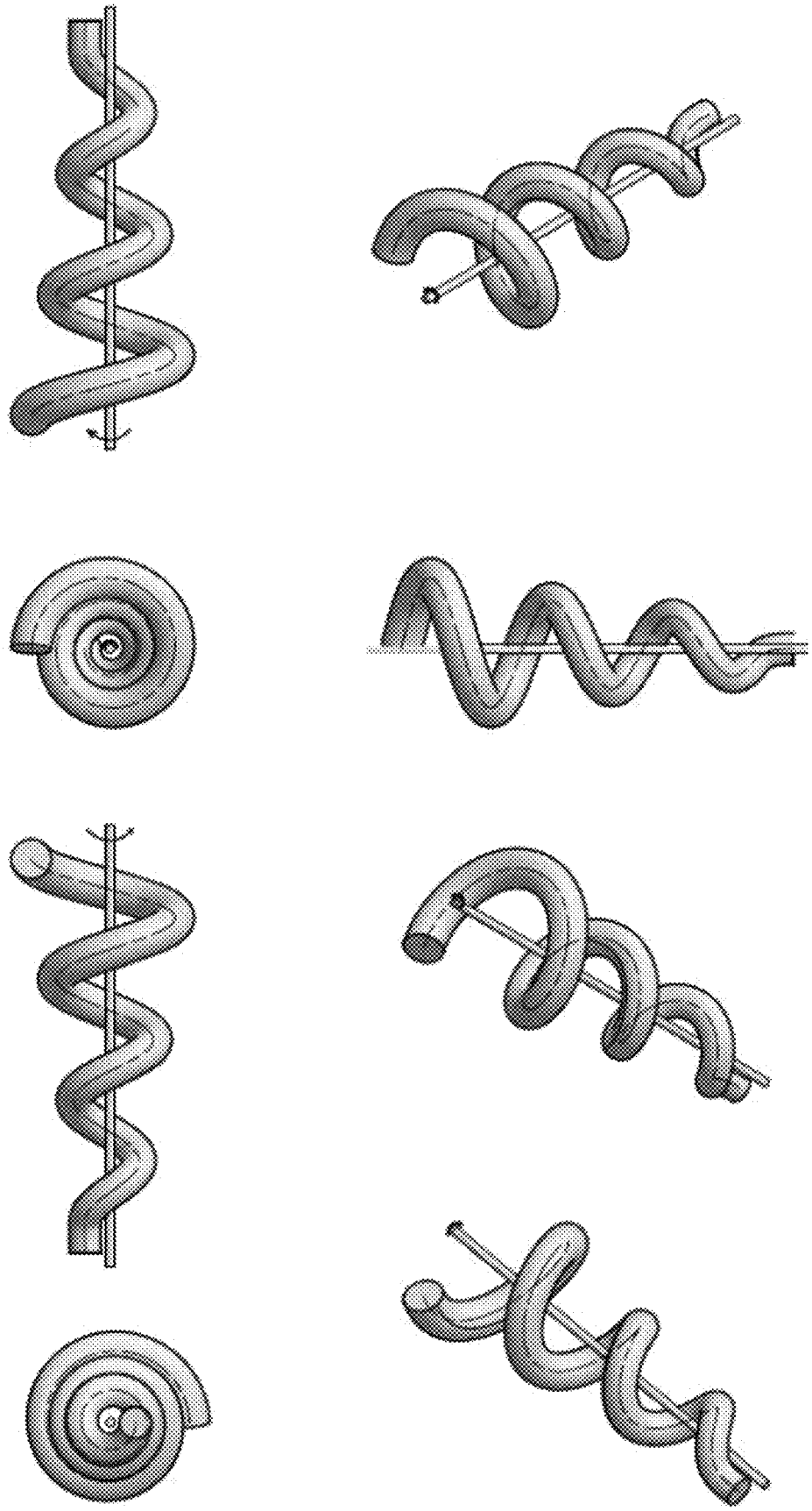
FIG. 17 illustrates an example of a 3-revolution 1-phase deformable variable helical cylinder according to the present invention.

The cylinder view of FIG. 17 illustrates an example of the 3-revolution 1-phase deformable variable helical cylinder. The illustrated 3-revolution 1-phase deformable variable helical cylinder also has a shape in which the radius of the helix and the inner diameter of the cylinder decrease from the inlet to the outlet to increase the compression of the inflow fluid. Here, the arrangement relationship in each drawing is the same as the case of the 1-revolution 1-phase deformable variable helical cylinder of FIG. 8.

Figure 18:
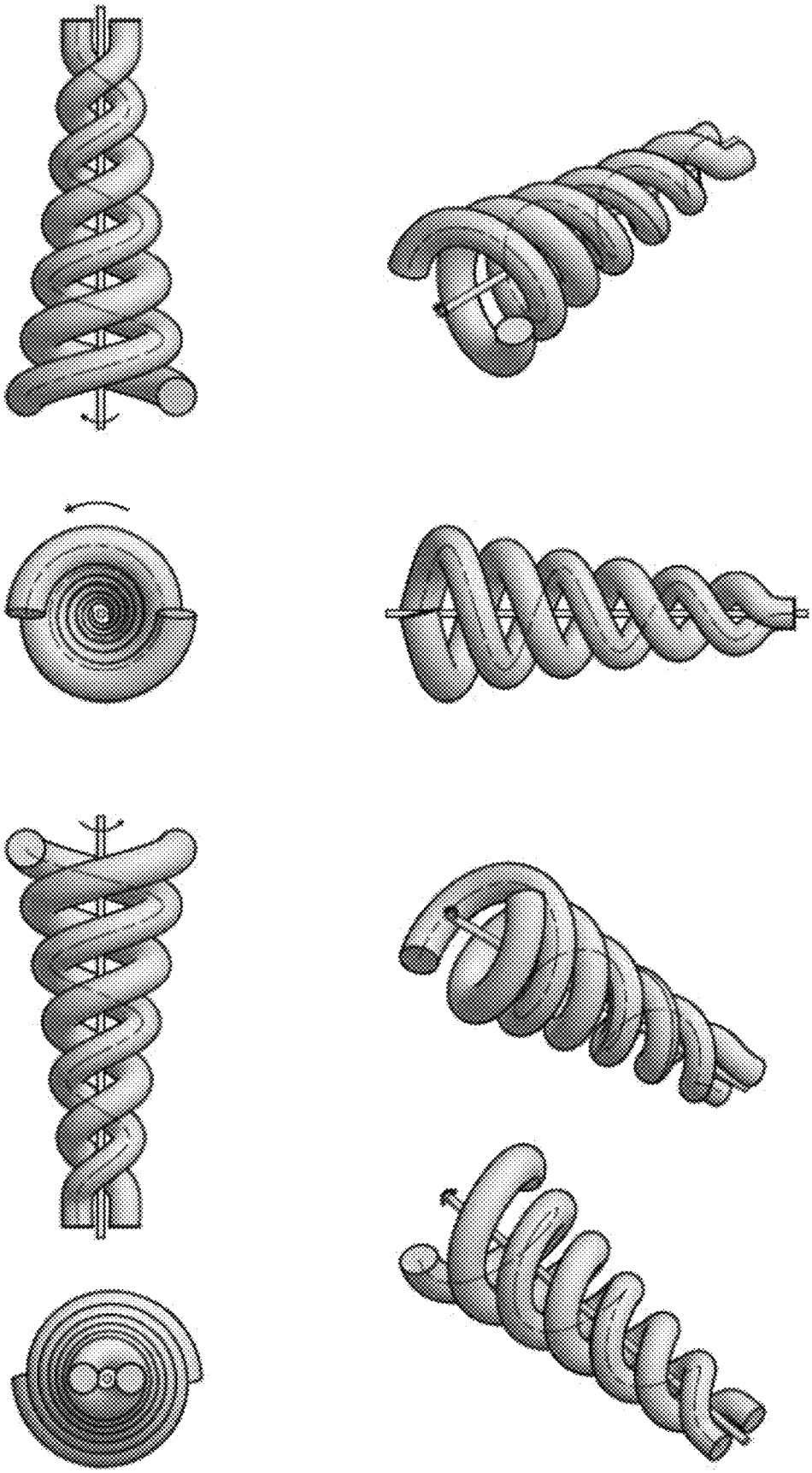
FIG. 18 illustrates an example of a 3-revolution 2-phase deformable variable helical cylinder according to the present invention.

The 3-revolution 2-phase deformable variable helical cylinder of FIG. 18 is obtained by disposing two 3-revolution 1-phase deformable variable helical cylinders of FIG. 17 with a phase difference of 180 degrees. When the same external rotational force as that in the 3-revolution 1-phase cylinder of FIG. 17 acts on the 3-revolution 2-phase cylinder, the total thrust increases proportionally due to the two cylinders.

Figure 19:
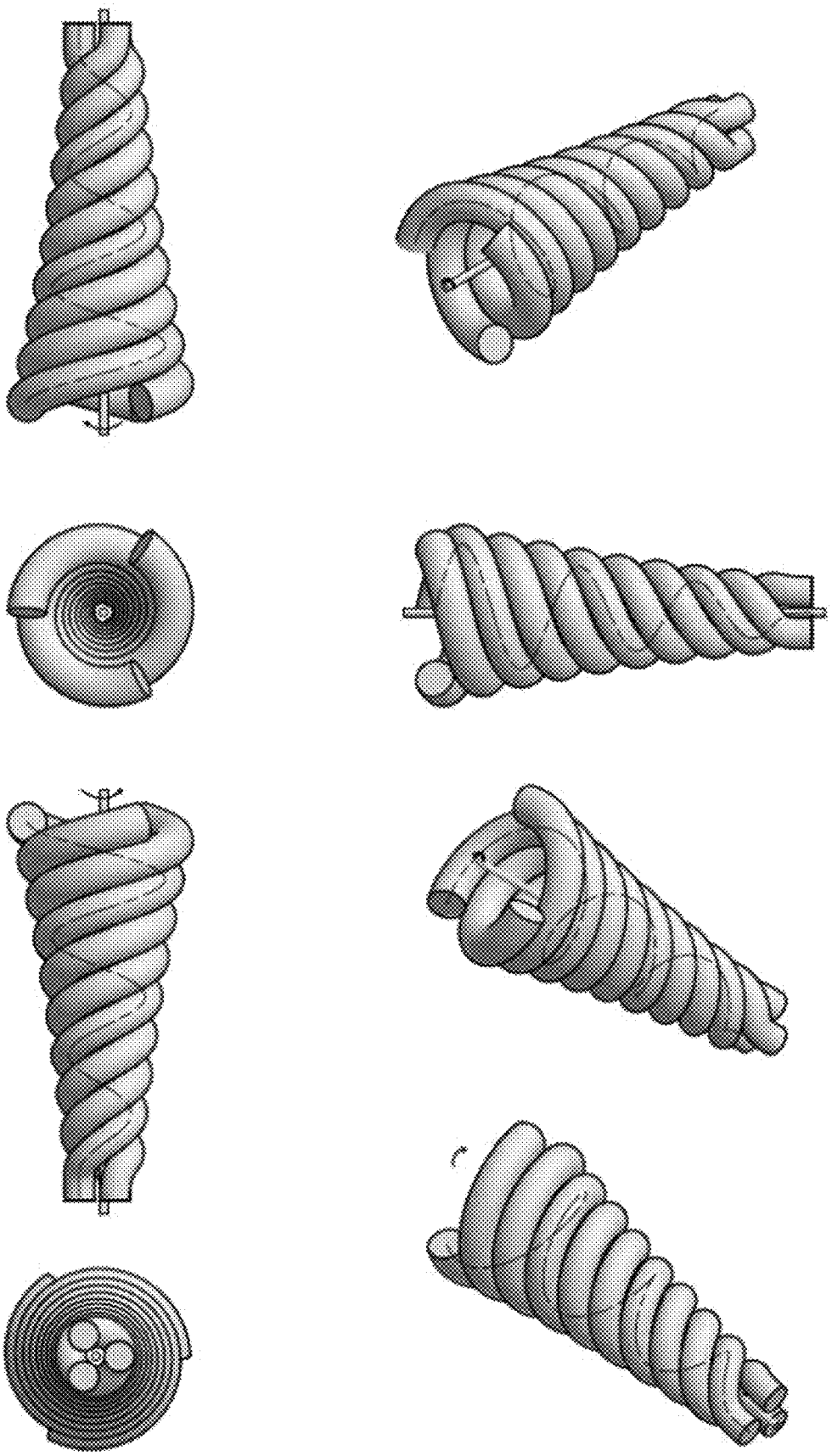
FIG. 19 illustrates an example of a 3-revolution 3-phase deformable variable helical cylinder according to the present invention.

The 3-revolution 3-phase deformable variable helical cylinder of FIG. 19 is obtained by disposing three 3-revolution 1-phase deformable variable helical cylinders of FIG. 17 with a phase difference of 120 degrees, and when the same external rotational force as that in the 3-revolution 1-phase cylinder of FIG. 17 acts on the is the 3-revolution 3-phase cylinder, the total thrust increases proportionally due to the three cylinders.

Although the above deformable variable helical cylinder only has a circular or oval cross-section as an example, the internal cross-section can be configured in various shapes of polygons such as triangles, squares, pentagons, and hexagons, or star shapes to suit the application.

Figure 20:
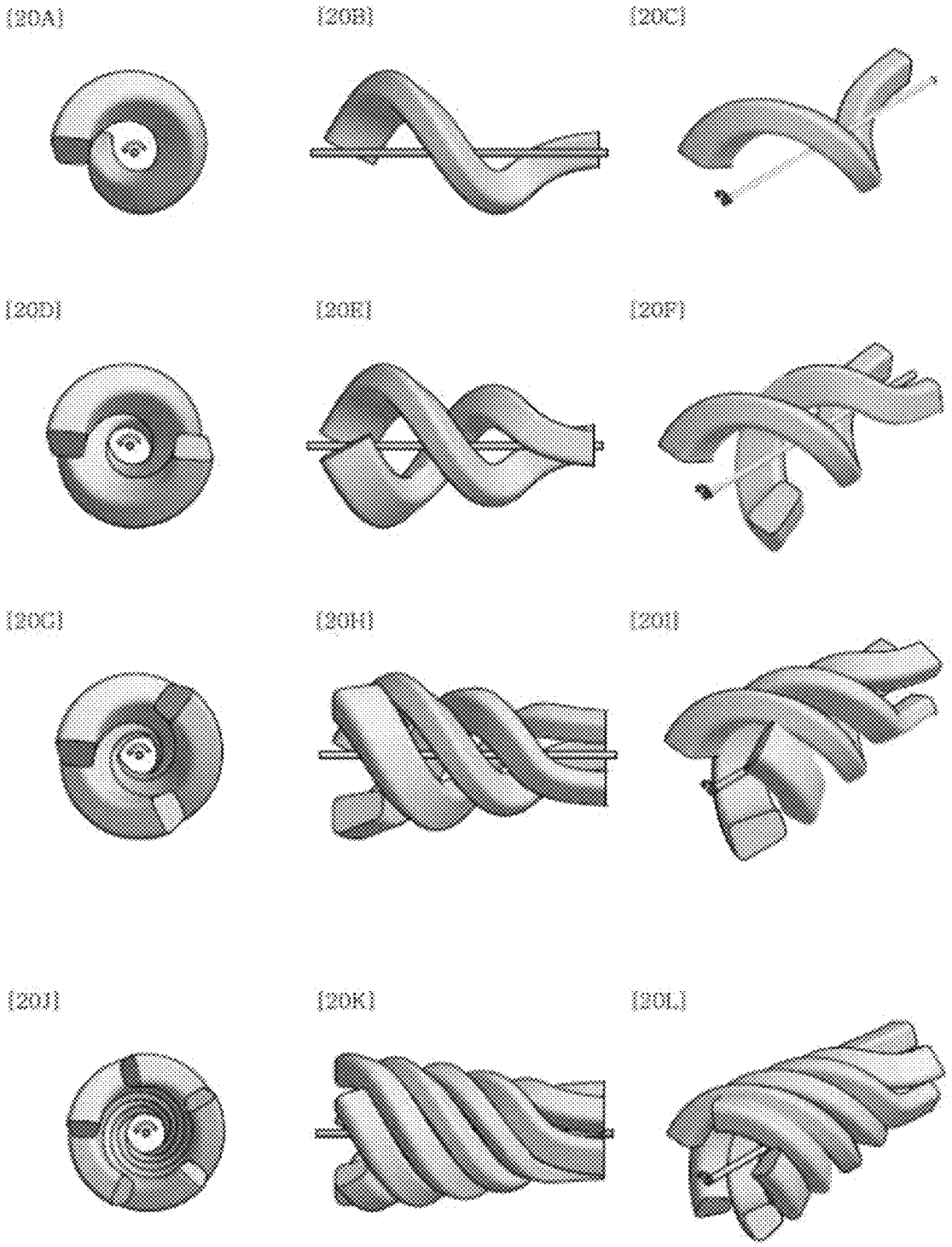
FIGS. 20A-20L illustrate various examples of a trapezoidal deformable variable helical cylinder according to the present invention.

FIG. 20 illustrates a deformable variable helical cylinder with a trapezoidal cross-section. Except that the cross section is not circular, the rest of the configuration is the same or similar to the cylinder with a cylindrical cross section.

FIG. 20A is a front view of the 1-revolution 1-phase trapezoidal deformable variable helical cylinder, FIG. 20B is a right side view, and FIG. 20C is an isometric view. FIGS. 20D, 20E, and 20F illustrate the 1-revolution 2-phase trapezoidal deformable variable helical cylinder, FIGS. 20G, 20H, and 20I illustrate the 1-revolution 3-phase trapezoidal deformable variable helical cylinder, and FIGS. 20J, 20K, and 20L illustrate the 1-revolution 5-phase trapezoidal deformable variable helical cylinder.

For the sake of explanation, the deformable variable helical cylinder described so far is illustrated and explained as having a very thin cylinder wall, and the shapes of the outside and inside (empty space) of the cylinder are equal to each other. However, in actual applications, the outside shape can take various forms. In other words, an inside of a solid can be cut out to form the deformable variable helical cylinder inside the solid. Several devices can be made in this way, some of which include a marine propeller, an aviation propeller, industrial and domestic nozzles, and a jet engine casing.

A propeller to which the deformable variable helical cylinder is applied will be described with reference to FIGS. 21 to 28.

The outline of the propeller is configured of one or more fins. If there is one fin, it refers to 1-fin, if there are two fins, it refers to 2-fin, if there are three fins, it refers to 3-fin, and the like. The example illustrated here is a 1-revolution 3-phase 3-fin propeller (hereinafter referred to as the 1-revolution 3P3F propeller). In addition, the number of revolutions of each fin is independent of the number of revolutions of the cylinder. In other words, even if the number of revolutions of the cylinder is one (revolution of 360 degrees), the number of revolutions of the fins may be equal to or less than, or equal to or more than 360 degrees.

Figure 21:
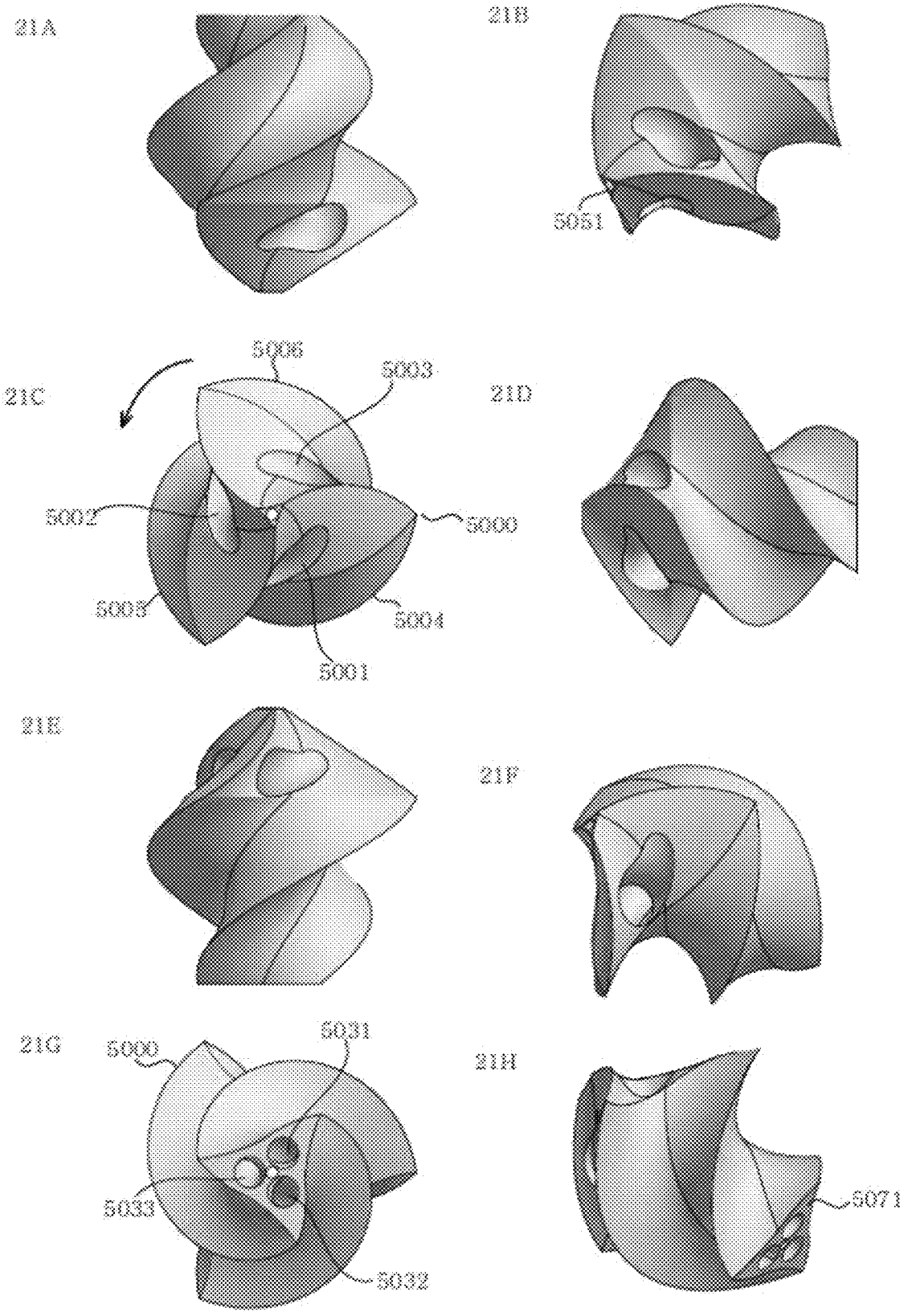
FIGS. 21A-21H illustrate examples of a 1-revolution 3P3F propeller according to the present invention.

FIG. 21 is an example of the 1-revolution 3P3F (3-phase 3-fin) propeller in which a fin is formed outside a solid bulk and the 1-revolution deformable variable helical cylinder is formed therein as if the inside is cut out.

Based on the front view of FIG. 21C, the plan view of FIG. 21A, the right side view of FIG. 21D, and the bottom view of FIG. 21E are disposed on the upper, right, and lower sides, respectively. The isometric views of FIGS. 21B and 21*f*, which are viewed obliquely from the front, are also disposed on the upper right and lower right sides. The rear view of FIG. 21G is disposed on the lower side of the bottom view, and the isometric view of FIG. 21H viewed obliquely from the rear side is disposed on the right side thereof.

When viewed from the front, the outside of the 3P3F propeller 5000, which rotates counterclockwise, is formed of three fins (3-fin) 5004, 5005, and 5006, and the inside thereof is formed of three cylinders (3-phase). The inlets 5001, 5002, and 5003 of the cylinder is visible in all directions except the rear surface 5071, and the outlets 5031, 5032, and 5033 of the cylinder is visible on the rear surface 5071.

The propeller in FIG. 21 has a structure in which a hollow 5051 is formed along the rotational central axis of the helix to accommodate a shaft for transmitting the external rotational force.

Figure 22:
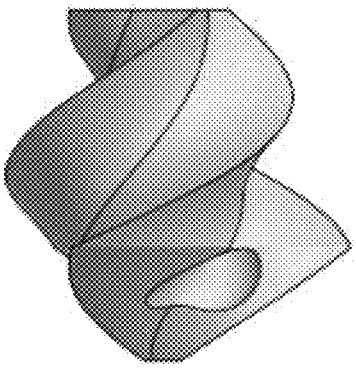
FIGS. 22A-22H illustrate examples of the 3P3F propeller of FIG. 21 and its corresponding inner cylinder.
Figure 22:
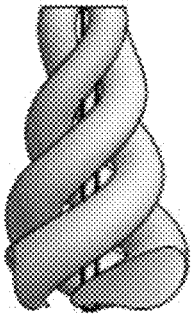
Figure 22:
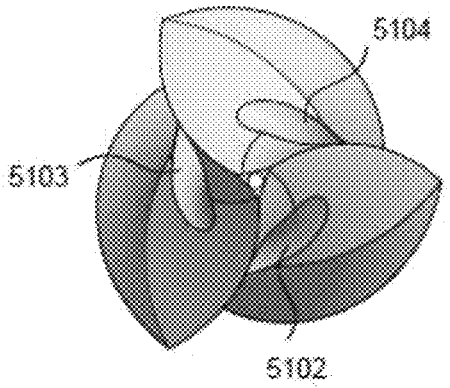
Figure 22:
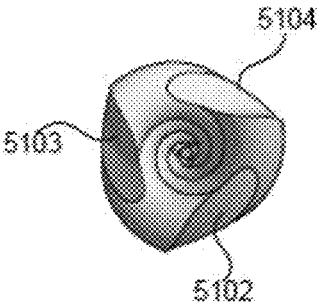
Figure 22:
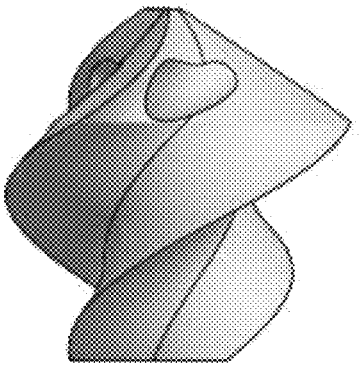
Figure 22:
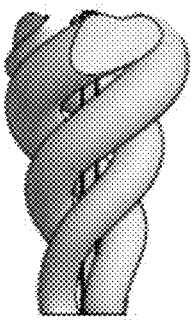
Figure 22:
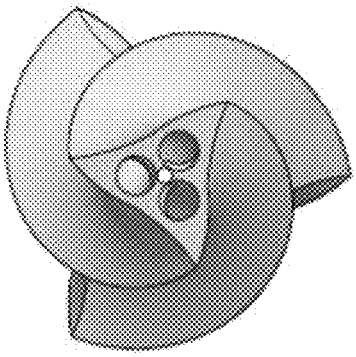
Figure 22:
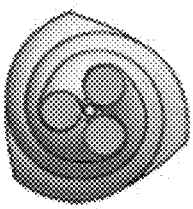

FIG. 22 illustrates the outline of the 3P3F propeller of FIG. 21 and the cylinder formed therein.

FIGS. 22B, 22D, 22F, and 22H illustrate the empty spaces, that is, the cylinders formed inside the propellers of FIGS. 22A, 22C, 22E, and 22G in three dimensions, respectively, and correspond to the front view, plan view, bottom view, and rear view of the cylinder. The three cylinder inlets 5102, 5103, and 5014 formed in the left propeller are identical to the three cylinder inlets 5102, 5103, and 5014 formed in each cylinder.

Figure 23:
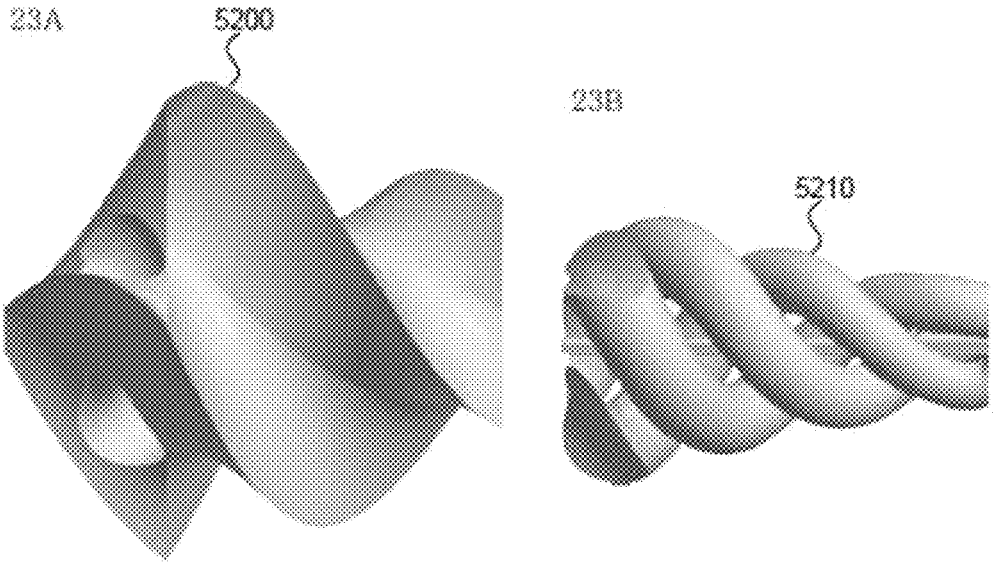
FIGS. 23A-23B are enlarged views of the 3P3F propeller of FIGS. 22A-22H and its corresponding inner cylinder.

FIG. 23 illustrates an enlarged view of the 3P3F propeller of FIG. 22 and the cylinder therein.

In FIG. 23A, each fin 5200 rotates approximately 220 degrees, while in FIG. 23B, each cylinder 5210 inside thereof rotates 360 degrees. In this way, the flow of the fluid flowing into the cylinder can be adjusted using the correlation between the number of revolutions of the fin and the number of revolutions of the cylinder, and the internal rotational force, the internal pressure, the thrust, and the like of the propeller can be adjusted to optimize the external rotational force or the angular speed.

Figure 24:
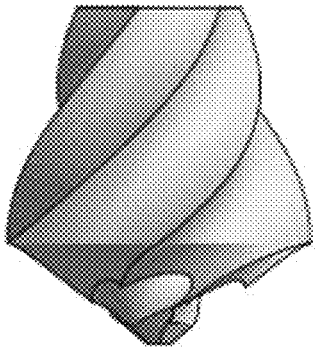
FIGS. 24A-24H illustrate examples of a 1-revolution 3P6F propeller according to the present invention.
Figure 24:
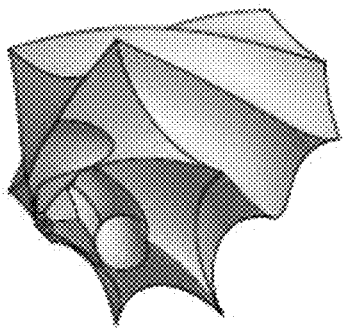
Figure 24:
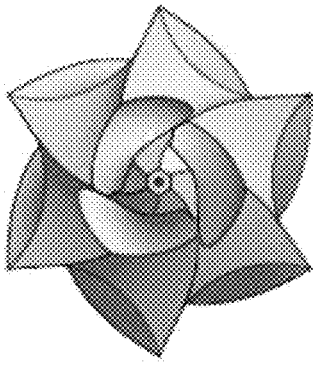
Figure 24:
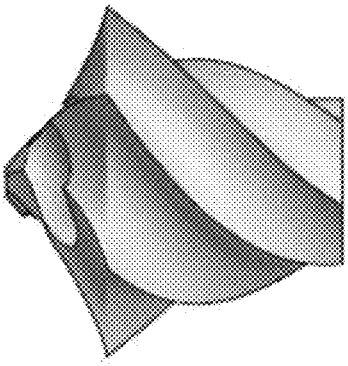
Figure 24:
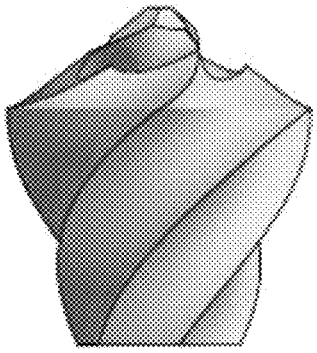
Figure 24:
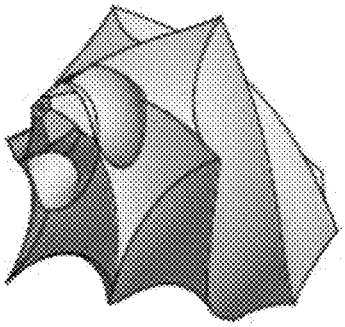
Figure 24:
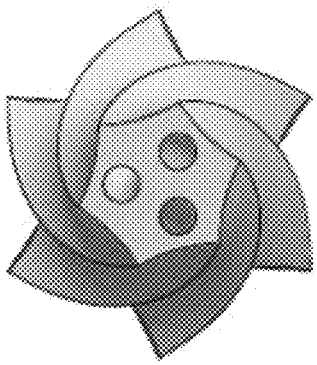
Figure 24:
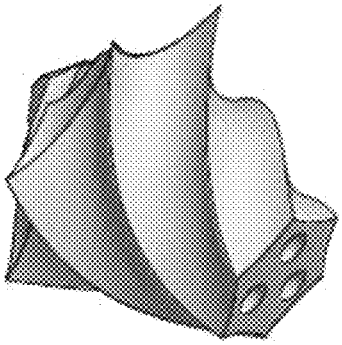

FIG. 24 illustrates the 1-revolution 3P6F propeller, and the arrangement of each drawing is the same as that of FIG. 21.

Figure 25:
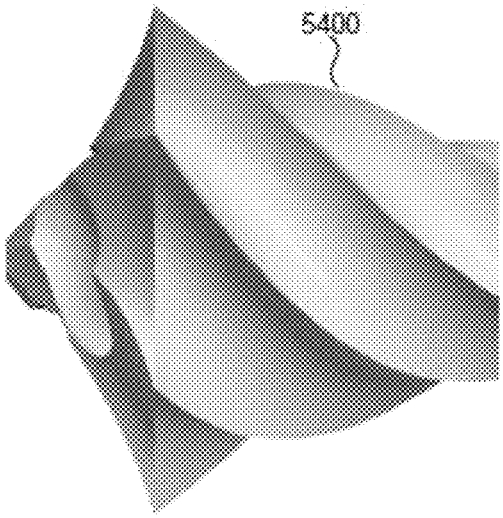
FIGS. 25A-25B are enlarged views of the 3P6F propeller of FIGS. 24A-24H and its corresponding inner cylinder.
Figure 25:
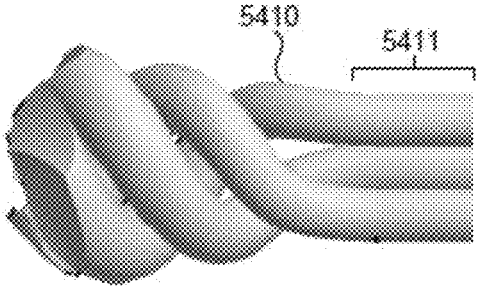

FIG. 25 illustrates the side of the 3P6F propeller and the cylinder inside thereof.

In FIG. 25A, each fin 5400 rotates approximately 166 degrees, while in FIG. 25B, each cylinder 5410 inside thereof rotates 360 degrees, so that the number of revolutions of the 3-phase cylinder is greater than the number of revolutions of the fin. In addition, the ratio of the outlet section 5411 to the total length is higher than that of the cylinder in FIG. 23. In addition to the correlation between the number of revolutions of the fin and the number of revolutions of the cylinder, the length or ratio of the cylinder outlet section can be used to control the flow of the fluid flowing into the cylinder, which affects the internal rotational force, the internal pressure, and the thrust of the propeller.

Figure 26:
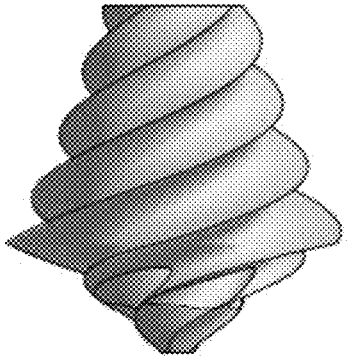
FIGS. 26A-26H illustrate examples of a 1-revolution 5P5F propeller according to the present invention.
Figure 26:
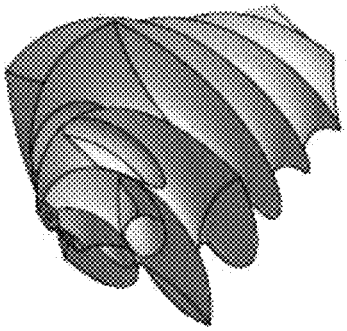
Figure 26:
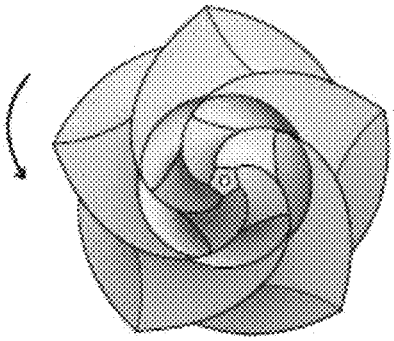
Figure 26:
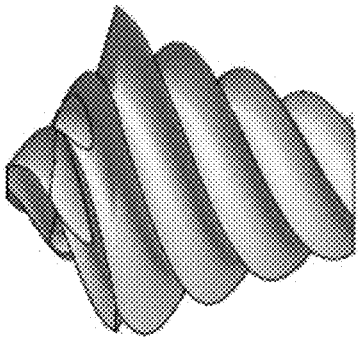
Figure 26:
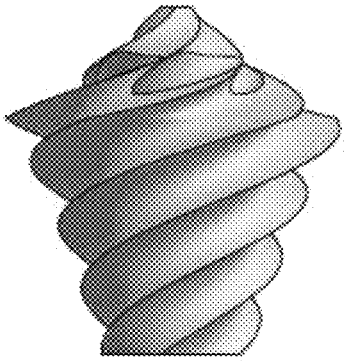
Figure 26:
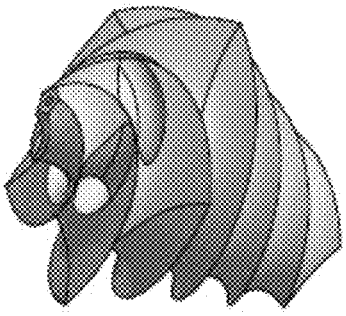
Figure 26:
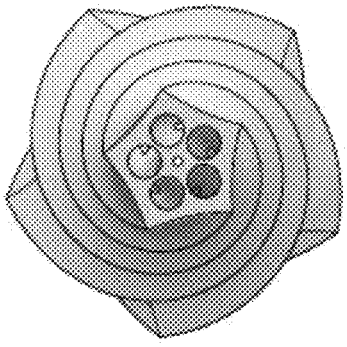
Figure 26:
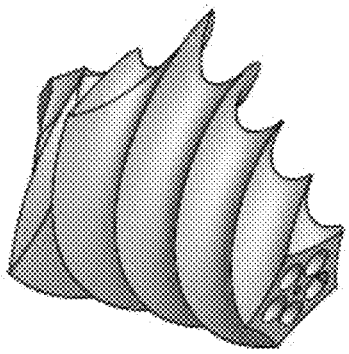

FIG. 26 illustrates the 1-revolution 5P5F propeller, and the arrangement of each drawing is the same as that of FIG. 24.

Figure 27:
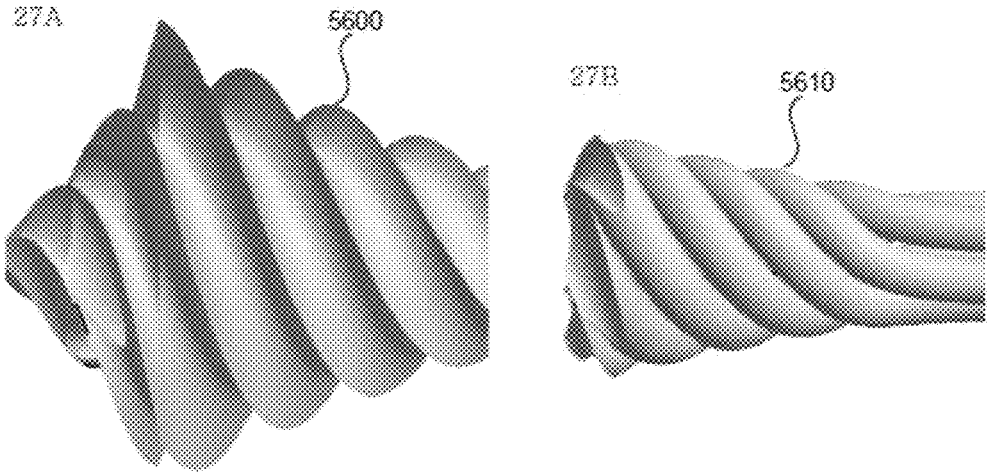
FIGS. 27A-27B are enlarged views of the 5P5F propeller of FIGS. 26A-26H and its corresponding inner cylinder.

FIG. 27 illustrates the side of the 5P6F propeller and the cylinder inside thereof.

In FIG. 27A, each fin 5600 rotates approximately 440 degrees, while in FIG. 27B, each cylinder 5610 inside thereof rotates 360 degrees, so that the number of revolutions of the 5-phase cylinder is less than the number of revolutions of the fin.

Figure 28:
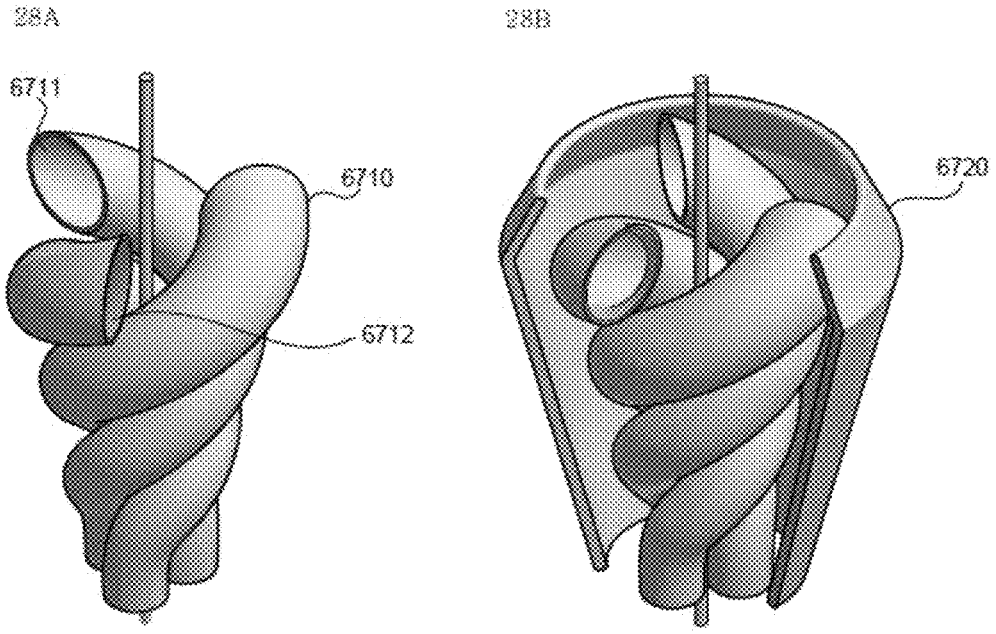
FIGS. 28A-28B illustrates an aviation propeller using a 1-revolution 3-phase cylinder according to the present invention.

FIG. 28 illustrates the finless hollow 1-revolution 3-phase propeller. FIG. 28A illustrates the 3-phase cylinders 6710, 6711, and 6712 constituting the main body of the 3-phase propeller, and FIG. 28B illustrates the 1-revolution 3-phase aviation propeller with the casing 6720 attached to the outside of the 3-phase cylinder.

Now, various types of nozzles using the deformable variable helical cylinder will be described using FIGS. 29 to 33.

Previously, the propellers using the deformable variable helical cylinders are assumed that the rotational motion is applied to the central axis of the cylinder from the outside, but here, it is assumed that the water or air current flows in through the inlet of the nozzle rather than applying the rotational motion. In particular, it is assumed that the pressures of the inflow water and air currents (that is, the water pressure and air pressure) are significant. The nozzle is also called an N-phase deformable variable helical nozzle (N-phase mVHC Nozzle) depending on the type of cylinder.

Figure 29:
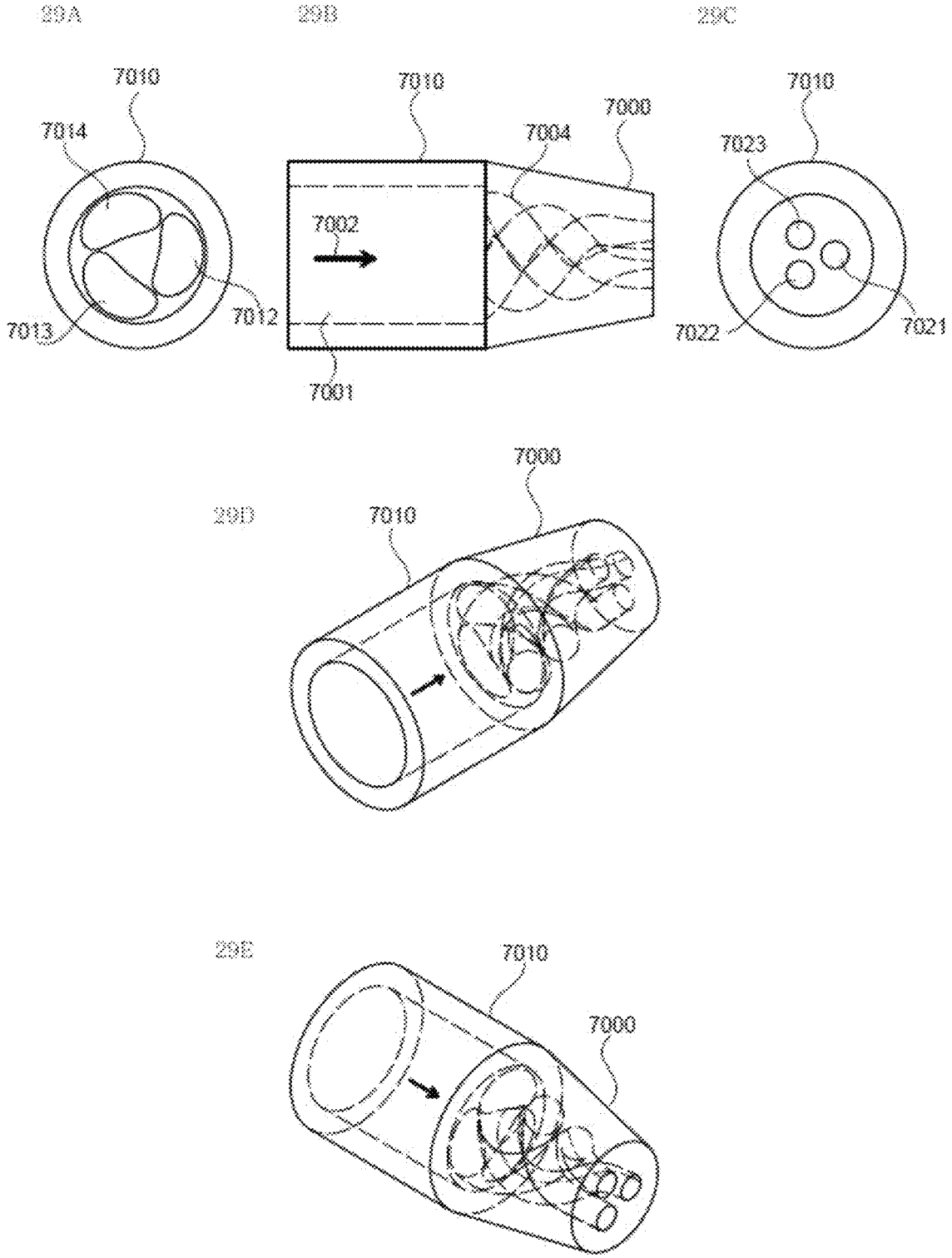
FIGS. 29A-29E illustrate a nozzle using a 1-revolution 3-phase cylinder according to the present invention.

FIG. 29 illustrates the 1-revolution 3-phase deformable variable helical nozzle.

FIG. 29A is a front view, FIG. 29B is a right side view, FIG. 29C is a rear view, and FIGS. 29D and 29E are isometric views viewed from different directions.

The nozzle is divided into the drum 7010 section and the cylinder 7000 section, and the drum 7010 is connected to the inlets 7012, 7013, and 7014 of the 3-phase deformable variable cylinder. When the fluid 7002 is delivered to the cylinder 7004 from the outside through the space 7001 inside the cylinder, compression and condensation occur inside the cylinder, and the fluid is ejected through the outlets 7021, 7022, and 7023.

The structure of a plurality of cylinders 7004 provided in the cylinder 7000 section is the deformable variable helical cylinder described above.

FIG. 30A is an outline view of FIG. 29E, and FIG. 30B illustrates the cylinder formed therein in three dimensions.

The sections of the drum 7010 and the cylinder 7000 in FIG. 30A are both formed of the material constituting the nozzle, but the inner space 7001 of the drum and the individual cylinder 7004 in FIG. 30B symbolize the empty space inside the material.

Meanwhile, the outer wall of the cylinder at the rear surface 7101 of the nozzle is relatively thick to prevent the outlet from bursting due to a large pressure being applied to the outlet of the cylinder.

Figure 31:
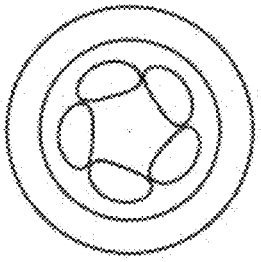
FIGS. 31A-31E illustrate a nozzle using a 1-revolution 5-phase cylinder according to the present invention.
Figure 31:
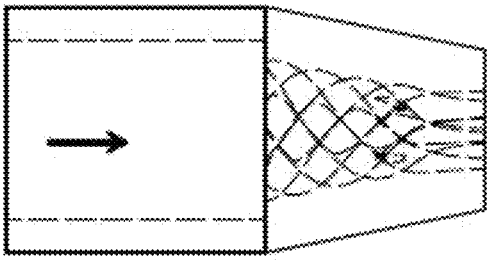
Figure 31:
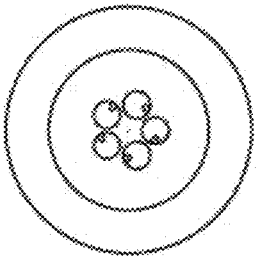
Figure 31:
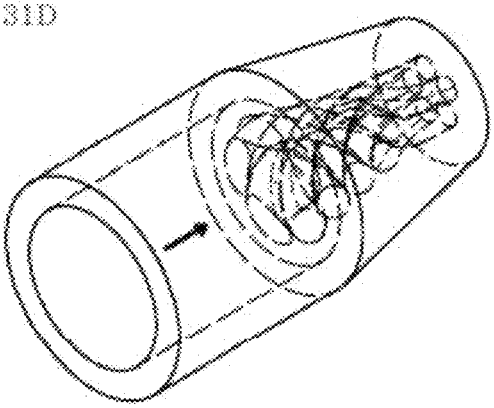
Figure 31:
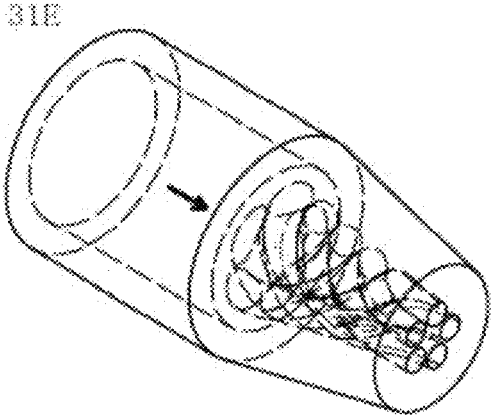
Figure 32:
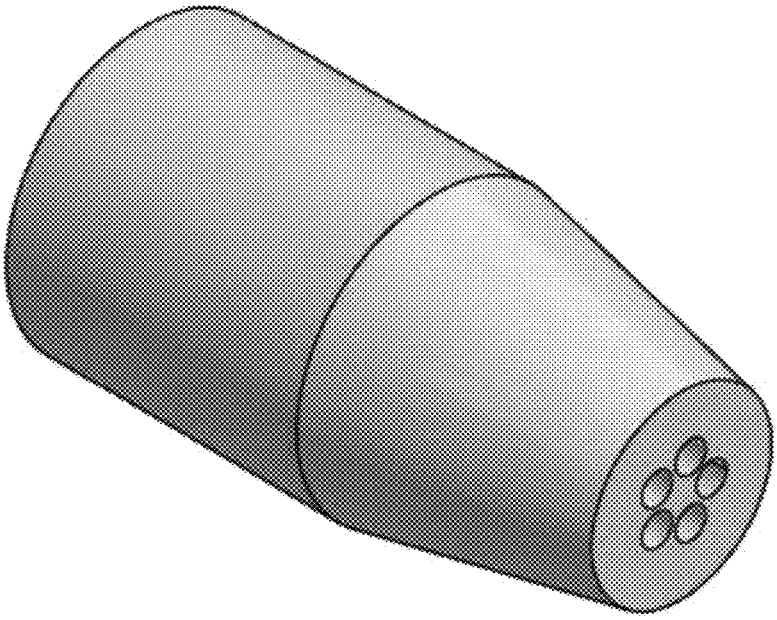
FIGS. 32A-32B are enlarged views of the nozzle of FIGS. 31A-31E and its corresponding inner cylinder.
Figure 32:
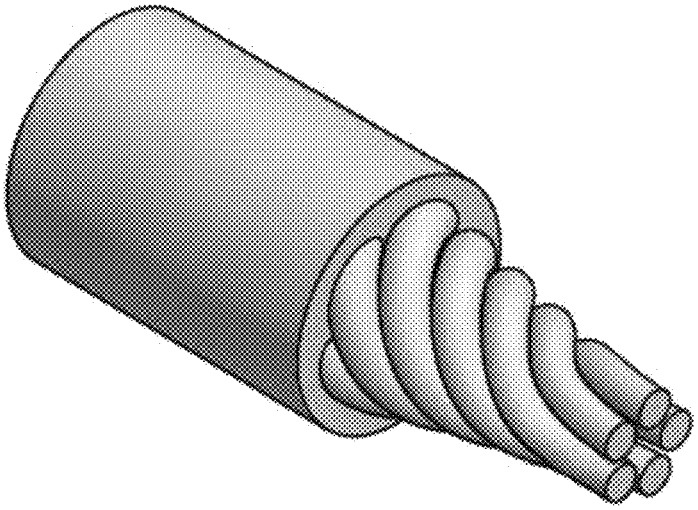
Figure 33:
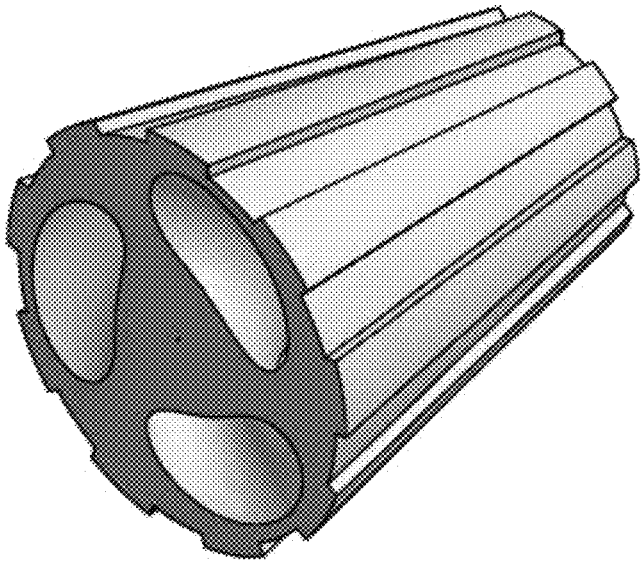
FIGS. 33A-33B illustrate a 1-revolution 3-phase nozzle without a cylindrical section according to the present invention.
Figure 33:
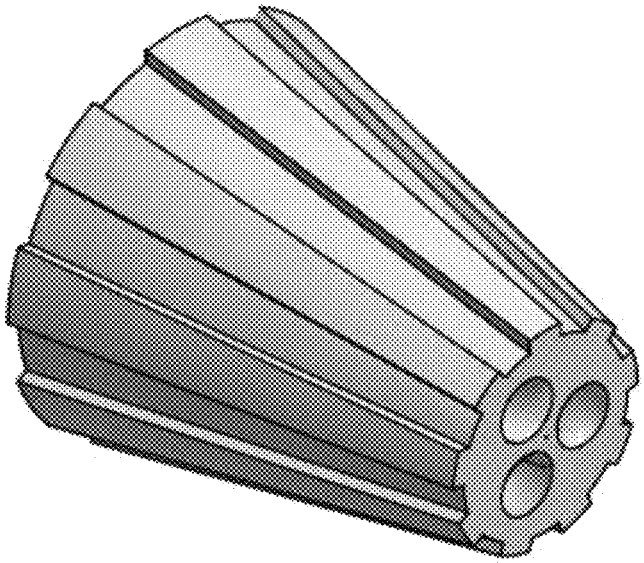

FIGS. 31 and 32 illustrate the 1-revolution 5-phase deformable variable helical nozzle.

Figure 30:
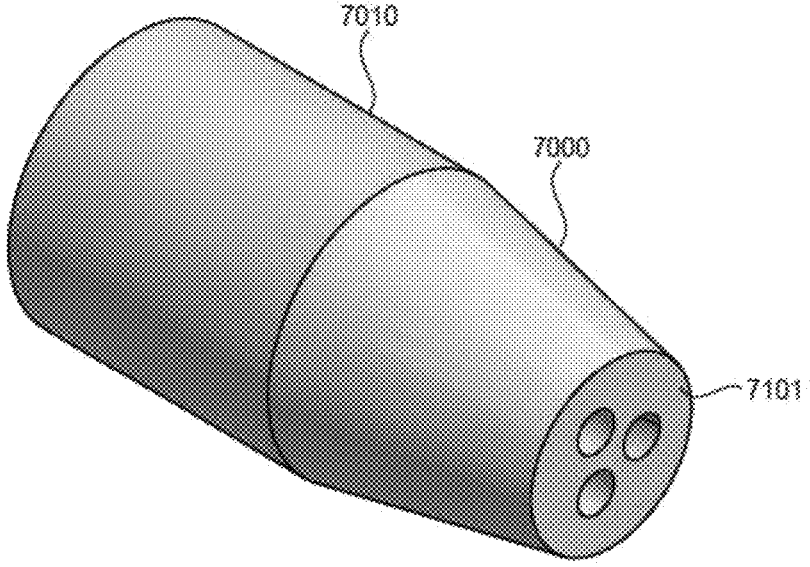
FIGS. 30A-30B are enlarged views of the nozzle of FIGS. 29A-29F and its corresponding inner cylinder.
Figure 30:
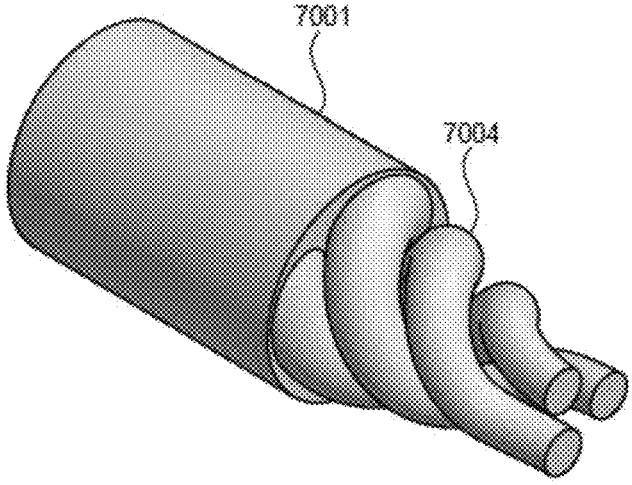

The arrangement of each drawing in FIG. 31 is the same as that of FIG. 29, and the arrangement of each drawing in FIG. 32 is the same as that of FIG. 30.

FIGS. 33A and 33B illustrate isometric views in which the 3-phase nozzle having no drum section viewed from different directions. The empty space inside the 3-phase nozzle is formed as the 3-phase cylinder.

FIGS. 34 to 39 illustrate various application examples using the deformable variable helical cylinder, the propeller, and the nozzle.

Figure 34:
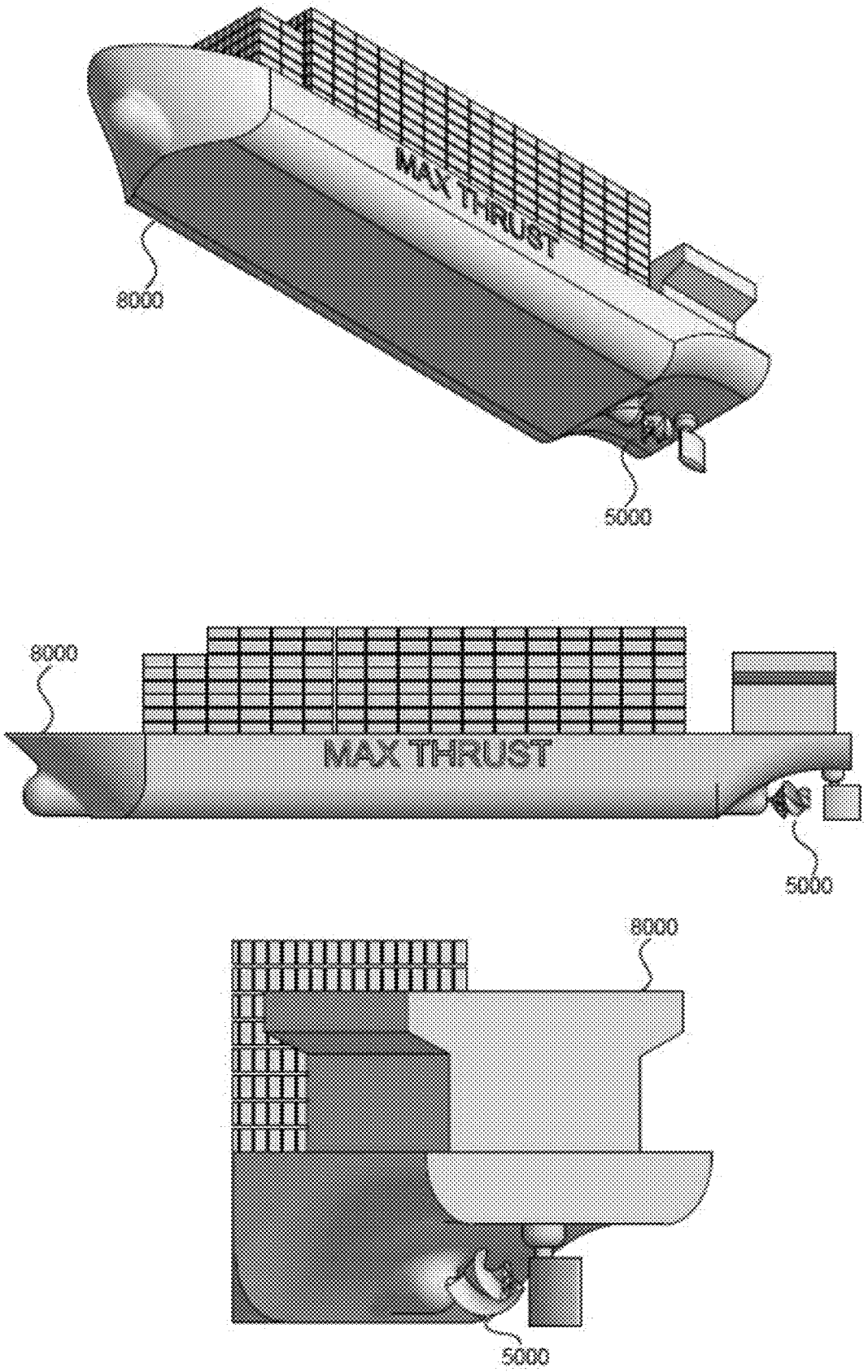
FIG. 34 is a projected view of a ship to which the 3P3F propeller according to the present invention is applied.

First, FIG. 34 is a view illustrating an example of the 1-revolution 3P3F propeller 5000 of FIG. 22 applied to the container ship 8000.

Figure 35:
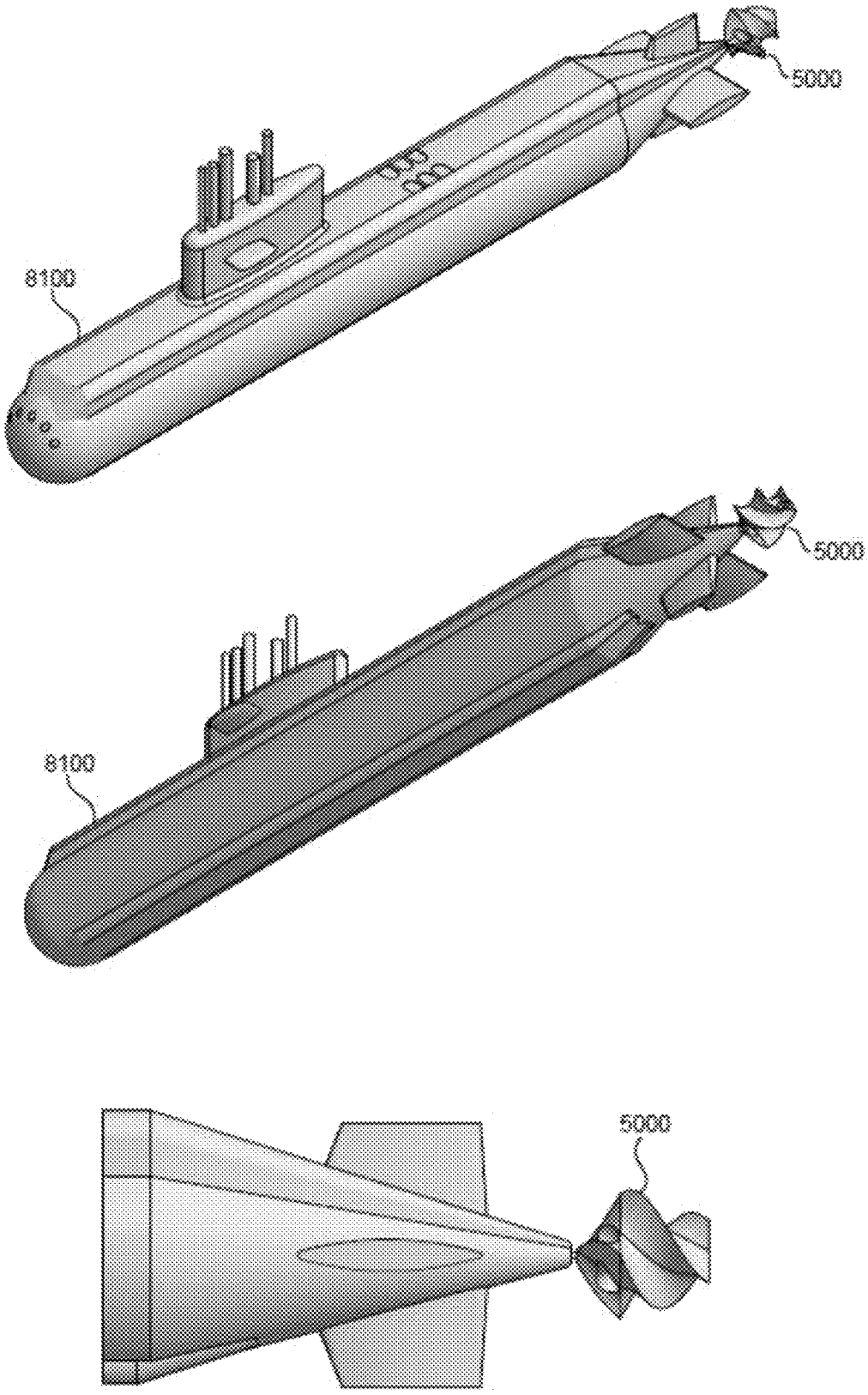
FIG. 35 is a projected view of a submarine to which the 3P3F propeller according to the present invention is applied.

FIG. 35 is a view illustrating an example of the 1-revolution 3P3F propeller 5000 of FIG. 21 applied to the submarine 8100.

Figure 36:
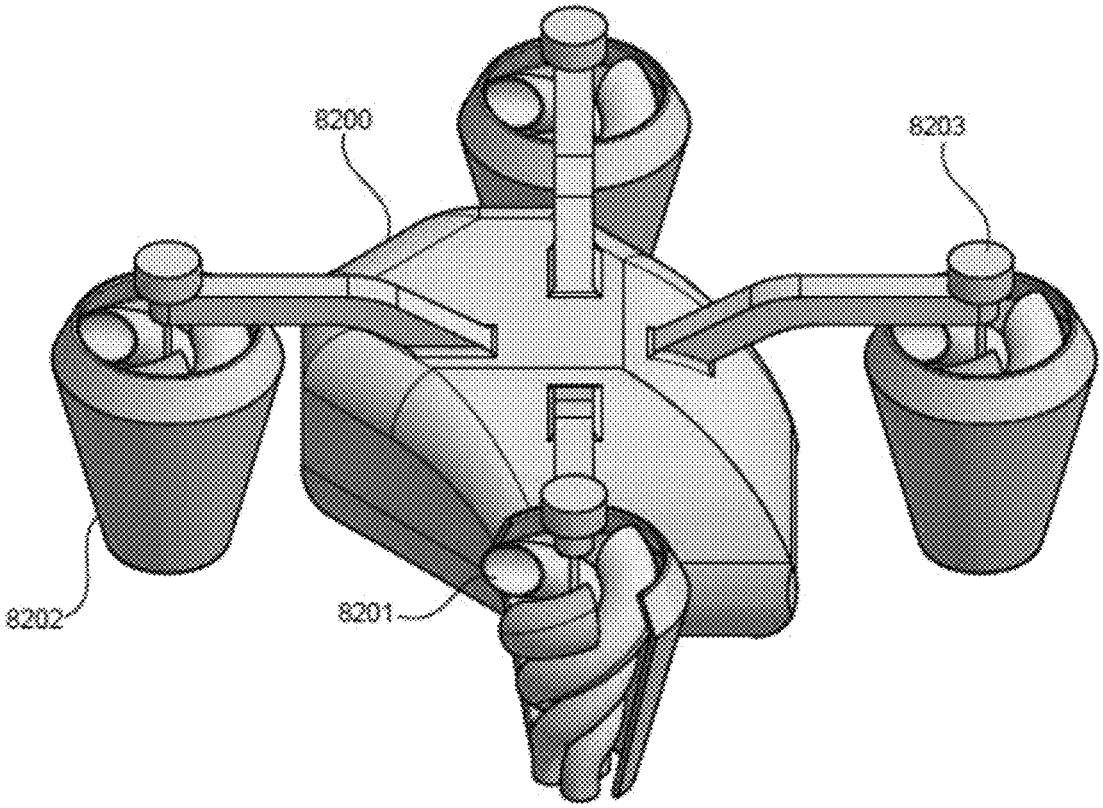
FIG. 36 is a projected view of a drone to which the 3-phase propeller according to the present invention is applied.

FIG. 36 is a view illustrating an example of the 1-revolution 3-phase propeller of FIG. 28 applied to the drone 8200. The 3-phase propeller configured of the cylinder 8201 and the casing 8202 is connected to each power transmission shaft 8203 of the drone 8200.

Figure 37:
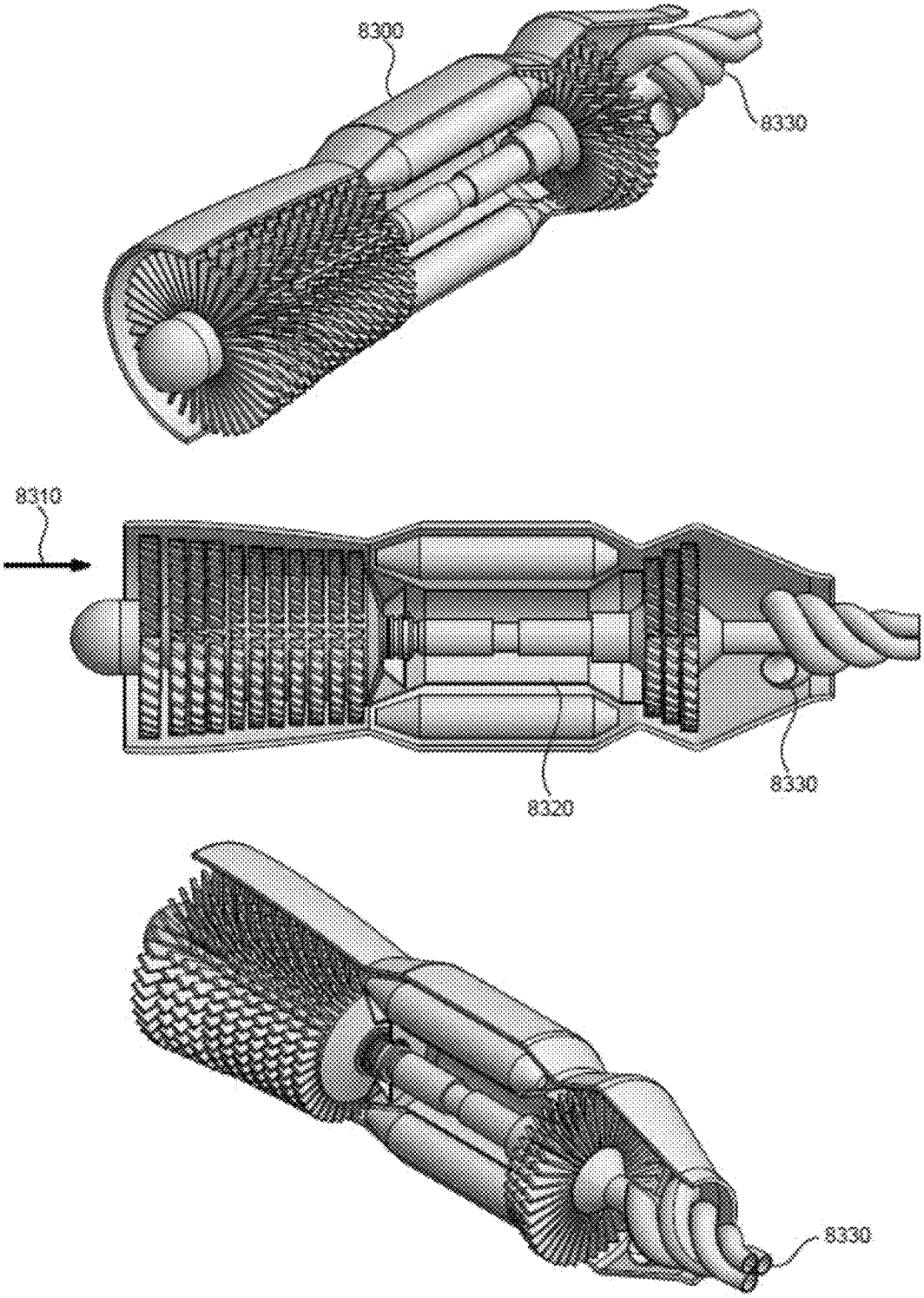
FIG. 37 is a projected view of a jet engine to which the 3-phase cylinder according to the present invention is applied.

FIG. 37 is a view illustrating an example of the 1-revolution 3-phase cylinder applied to the jet engine 8300. The central axis of the 3-phase cylinder is connected to the central axis of the jet engine and rotates like the jet engine. When the air current 8310 flowing into the jet engine ignites and explodes in the inside 8320 of the engine and ejects to the outlet of the jet engine, part or all of the ejected air current flows into the 3-phase cylinder 8330 to generate additional thrust and spraying force.

Figure 38:
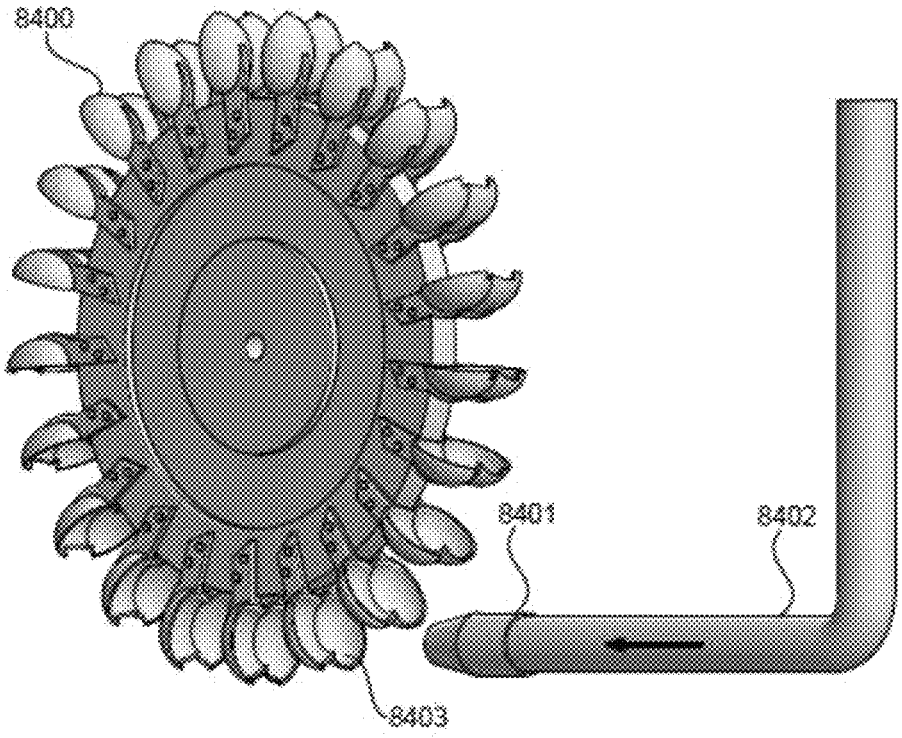
FIG. 38 is a projected view of a Pelton wheel to which the nozzle according to the present invention is applied.
Figure 38:
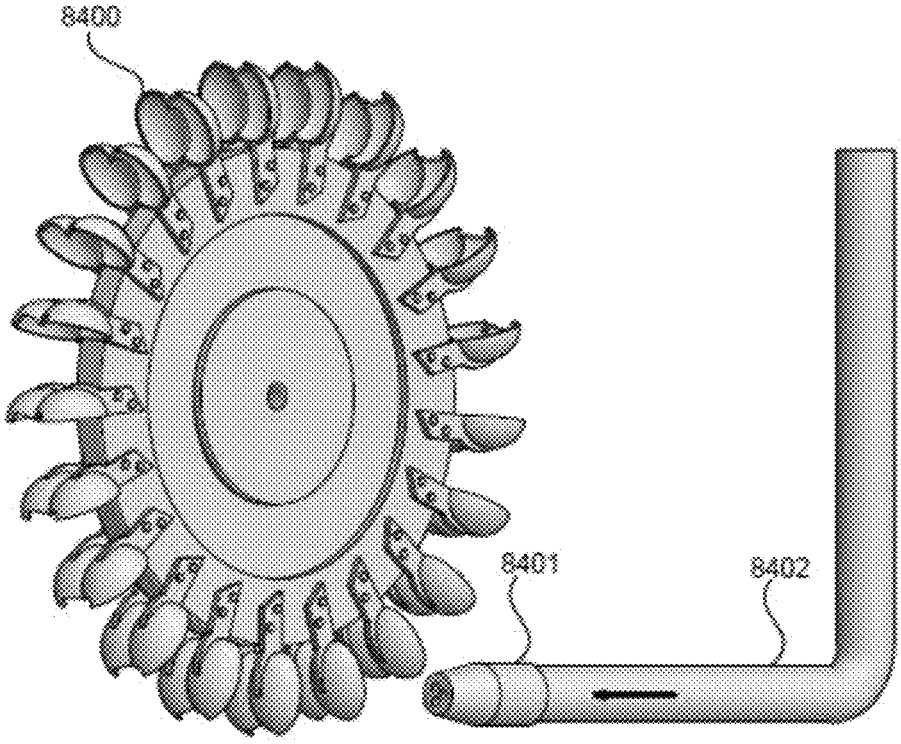

FIG. 38 is a view illustrating an example of the 1-revolution 3-phase deformable variable helical nozzle 8401 having the drum section and the cylinder section applied to a pelton wheel 8400 for hydroelectric power generation. Water flowing into the nozzle 8401 through the pipe 8402 is sprayed from the outlet of the nozzle 8401 and impacts the bucket 8403 of the pelton wheel 8400 to transmit power.

Figure 39:
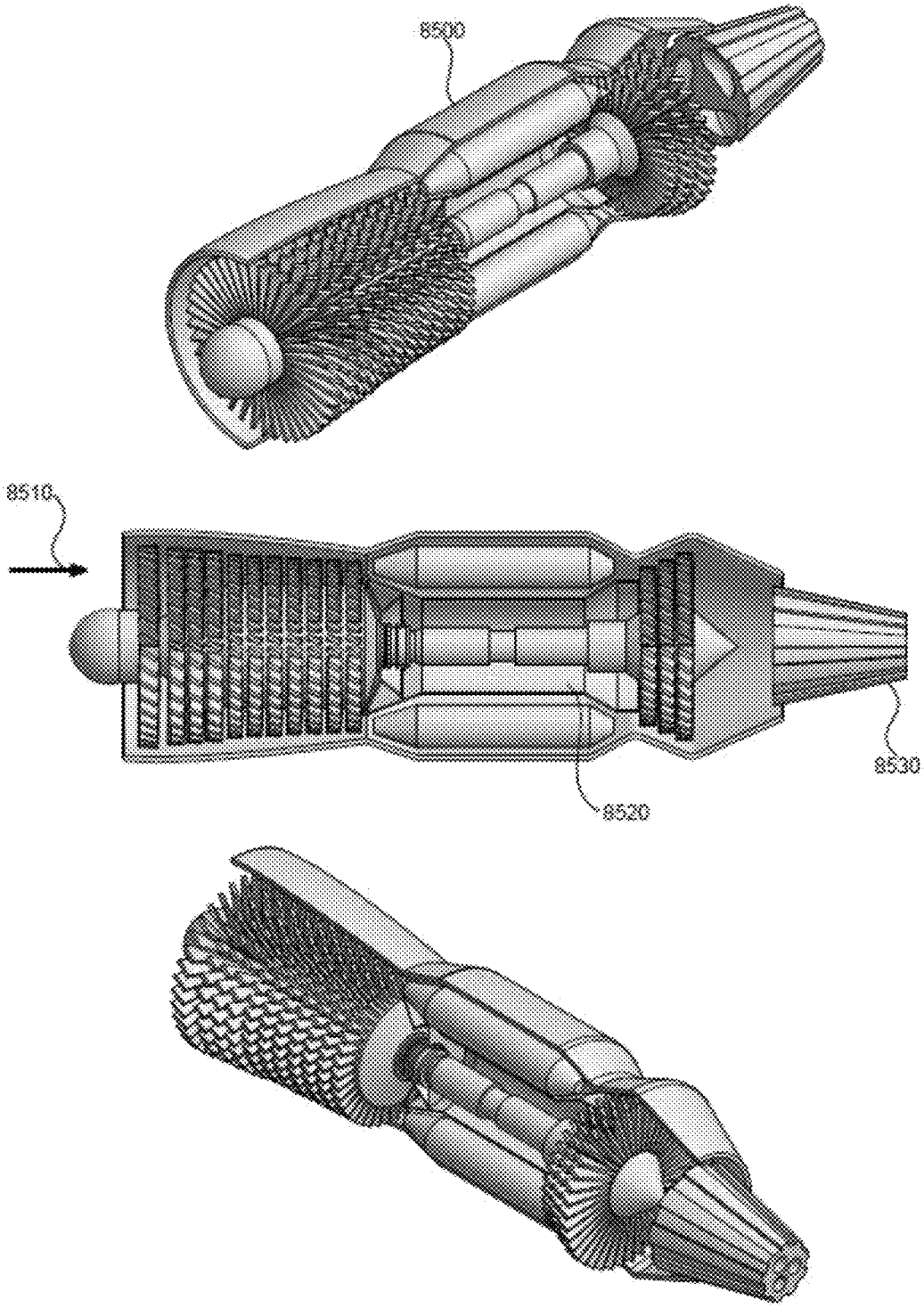
FIG. 39 is a projected view of a jet engine to which the 1-revolution 3-phase nozzle without the cylindrical section according to the present invention is applied.

FIG. 39 is a view illustrating an example of the 3-phase deformable variable helical nozzle having no drum section to the jet engine 8500. Here, unlike in FIG. 38, the 3-phase nozzle does not rotate together with the central axis, but is fixed so that it does not rotate. When the air current 8510 flowing into the jet engine ignites and explodes in the inside 8520 of the engine and ejects to the outlet of the jet engine, part or all of the ejected air current flows into the 3-phase cylinder 8530 to generate additional thrust and spraying force.

So far, the deformable variable helix and the deformable variable helical cylinder using the deformable variable helix are explained using various examples.

The deformable variable helical cylinder (mVHC) of the present invention has the following features.

(1) The cylinder refers to a hollow cylinder that connects between an 'inlet' and an 'outlet', and the part except for the inlet and outlet is closed to the outside. Therefore, when a rotational force is applied, the force generated by the rotational force is completely converted into linear motion in a state where the water or air current flowing into the outlet does not escape, and when pressure is applied, the force increased by the generation of the rotational force inside the cylinder is completely converted into the linear motion.

(2) The deformable variable helix is formed around the central axis of the cylinder.

(3) The cross-sectional area of the inlet side is wider than that of the outlet side of the cylinder with a cylindrical shape tapered from the inlet to the outlet of the cylinder.

(4) A plurality of one or more identical cylinders are disposed at a predetermined phase difference around the central axis.

(5) A fluid, that is, a water or air current, can enter through the inlet of the cylinder and exit through the outlet of the cylinder.

(6) The inlet of the cylinder is formed at an angle that maximizes the inflow of the fluid.

(7) As the helix gets closer to the end of the cylinder, the helix becomes parallel to the central axis of the cylinder, so the outlet of the cylinder is formed at an angle that allows the fluid to flow out parallel to the central axis of the cylinder.

(9) An external force acts on the deformable variable helical cylinder to generate a flow of the fluid to the inlet of the cylinder. This force may be the rotational motion of the cylinder or the pressure applied to the fluid. When a force is applied to rotate the cylinder based on the rotational central axis of the cylinder, the fluid flows into the inlet of the cylinder due to the rotational force of the cylinder. The pressure applied to the fluid in the direction of the inlet of the cylinder includes the water pressure or the air pressure acting on the inlet of the cylinder.

(10) When the fluid flows into the inlet of the cylinder, an internal rotational force is generated as the inflow fluid passes through the inside of the helical cylinder, the inner diameter of the cylinder narrows, and thereby the pressure in the fluid increase, a compressed fluid is injected at the outlet of the cylinder, and the thrust is generated in the cylinder. Since there is no loss of water or air current within the closed cylinder, the internal rotational force can be completely maintained, and the thrust and spraying force are obtained by converting the internal rotational force into the linear motion parallel to the central axis of the cylinder or the nozzle.

(11) The first feature of the propeller using the deformable variable helical cylinder (mVHC) is the correlation with the thrust resulting from the difference between the number N of cylinders and the number F of fins. By adjusting each of the numbers N and F, the most ideal thrust for the external rotational force can be derived.

(12) The second feature of the propeller is the correlation with the thrust resulting from the difference (that is, phase difference) between the number of revolutions (or phases) of the cylinder and the number of revolutions (or phases) of the fin. In other words, when the phase of the cylinder per unit length is set to 1, by making the phase of the fin smaller or larger, the most ideal thrust for the external rotational force can be derived using the phase difference between the cylinder and the fin.

(13) The deformable variable helical cylinder is defined as (i) the height and width of the cylinder, (ii) the number of revolutions of the cylinder within the entire height, (iii) the distance between the pitches, (iv) the area ratio of the inlet and outlet of the cylinder, and (v) the length or ratio of the linear outlet section.

(14) The height and width of the deformable variable helical cylinder are defined by the set of the radius at the starting point, the radius at the ending point, and the ending point, the projection point, and the projection line of the two-dimensional helix.

(15) The deformable variable helical cylinder is used for the water current or the air current.

(16) After determining whether the force driving the cylinder is the rotational force or the pressure, the optimal thrust or spraying force can be obtained by adjusting the ratio of (i), (ii), (iii), (iv), and (v) described above.

(17) The deformable variable helical cylinder is applicable to various applications requiring the thrust in various industrial fields. Representative examples of applicable applications are the propeller and the nozzle.

In this specification, the present invention has been described with reference to the embodiments illustrated in the drawings so that those skilled in the art can easily understand and reproduce the present invention. However, these are merely illustrative examples and those skilled in the art will understand that various modifications and equivalent embodiments are possible from the embodiments of the present invention. Therefore, the true technical protection scope of the present invention should be determined only by the appended claims.

The invention claimed is:

1. A helical cylinder having a plurality of cylinders that helically rotate around the same rotational central axis, wherein each of the cylinders has an inlet for an inflow of a fluid and an outlet for an outflow of the fluid, a cylinder body between the inlet and the outlet is closed, the number of revolutions of a helix over an entire length of the helical cylinder is M, where M is a positive real number, and the number of cylinders is N, where N is a natural number greater than or equal to 2, wherein the cylinders are arranged mutually spaced apart around the rotational central axis, and are disposed in a twisted configuration such that the cylinders cross each other and helically rotate along the rotational central axis, and wherein a diameter of each of the cylinders gradually decreases from an inlet side to an outlet side, and an outlet portion of each of the cylinders is provided with an outlet section in which corresponding cylinder extends parallel to the rotational central axis.

2. The helical cylinder according to claim 1, wherein the N cylinders are spaced apart from each other in the same phase.

3. The helical cylinder according to claim 1, wherein at least one of the cylinders has a circle or a polygon cross-section.

4. A propeller comprising:

the helical cylinder according to claim 1; and a casing surrounding the helical cylinder.

* * * * *